US012473909B2

(12) United States Patent
Hunter et al.

(10) Patent No.: US 12,473,909 B2
(45) Date of Patent: Nov. 18, 2025

(54) ACTIVE BELLOWS PUMP VALVE MANAGEMENT

(71) Applicant: Halliburton Energy Services, Inc., Houston, TX (US)

(72) Inventors: Timothy Holiman Hunter, Duncan, OK (US); Justin Lee Hurst, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 60 days.

(21) Appl. No.: 18/398,923

(22) Filed: Dec. 28, 2023

(65) Prior Publication Data

US 2024/0376891 A1 Nov. 14, 2024

Related U.S. Application Data

(60) Provisional application No. 63/501,995, filed on May 12, 2023.

(51) Int. Cl.
*F04B 53/10* (2006.01)
*E21B 43/12* (2006.01)
(Continued)

(52) U.S. Cl.
CPC ..... *F04B 53/10* (2013.01); *E21B 43/12* (2013.01); *F04B 43/08* (2013.01); *F04B 51/00* (2013.01)

(58) Field of Classification Search
CPC ..... F04B 19/22; F04B 49/22; F04B 53/10; F04B 2201/0201; F04B 2205/05; F04B 43/0081; F04B 43/084; F04B 43/113; F04B 43/08; F04B 51/00; F04B 15/02; F04B 43/0736; E21B 43/12
See application file for complete search history.

(56) References Cited

U.S. PATENT DOCUMENTS 1,256,127 A 2/1918 Gould
1,301,485 A 4/1919 Mueller
(Continued)

FOREIGN PATENT DOCUMENTS

CN 201982789 U 9/2011
CN 104763410 A 7/2015
(Continued)

OTHER PUBLICATIONS

WO2022164034_Translation; Aug. 4, 2022; Park.*
(Continued)

*Primary Examiner* — Jesse S Bogue
(74) *Attorney, Agent, or Firm* — Conley Rose, P.C.; Rodney B. Carroll

(57) ABSTRACT

Disclosed embodiments may relate to bellows pumps for introducing treatment fluid into a well. Wear issues, for example causing leakage of the discharge valve, can lead to pressure build-up in the pump chamber which may eventually damage the bellows. Disclosed embodiments may be configured to prevent such damage to the bellows due to discharge valve leakage. For example, in some embodiments a mechanism may hold open the suction valve during pump stoppage, to prevent pressure accumulation. Alternate embodiments may be configured to protect the bellows, even when the pump continues to run. Related methods are also disclosed.

20 Claims, 13 Drawing Sheets

(51) Int. Cl.
*F04B 43/08* (2006.01)
*F04B 51/00* (2006.01)

(56) References Cited

U.S. PATENT DOCUMENTS

| | | | | |
|---|---|---|---|---|
| 1,650,377 | A | 11/1927 | Nixon | |
| 1,832,257 | A | 11/1931 | Stephens | |
| 2,464,095 | A | 3/1949 | Nies | |
| 2,546,302 | A | 3/1951 | Gehres et al. | |
| 2,613,607 | A | 10/1952 | Sheen et al. | |
| 2,735,369 | A | 2/1956 | Turvey | |
| 2,807,215 | A | 9/1957 | Hawxhurst | |
| 3,134,508 | A | 5/1964 | Yer et al. | |
| 3,151,562 | A | 10/1964 | Swartz | |
| 3,192,860 | A | 7/1965 | Hardison | |
| 3,338,170 | A | 8/1967 | Swartz | |
| 3,411,452 | A | 11/1968 | Czarnecki et al. | |
| 3,433,161 | A | 3/1969 | G. Vetter | |
| 3,524,714 | A | 8/1970 | Grove et al. | |
| 3,680,981 | A | 8/1972 | Wagner | |
| RE29,055 | E | 11/1976 | Wagner | |
| 4,003,679 | A | 1/1977 | McManigill | |
| 4,080,107 | A | 3/1978 | Ferrentino | |
| 4,406,595 | A | 9/1983 | Robertson et al. | |
| 4,439,112 | A | 3/1984 | Kitsnik | |
| 4,594,057 | A | 6/1986 | Morgan | |
| 4,948,349 | A | 8/1990 | Koiwa | |
| 5,220,943 | A | 6/1993 | Zink | |
| 5,246,351 | A | 9/1993 | Horn et al. | |
| 5,249,932 | A | 10/1993 | Van Bork | |
| 5,308,230 | A | 5/1994 | Moore | |
| 6,419,462 | B1 * | 7/2002 | Horie | F04B 43/073 417/394 |
| 6,554,578 | B1 | 4/2003 | Siegel | |
| 9,243,413 | B2 * | 1/2016 | Robol | F04D 15/0077 |
| 9,518,577 | B2 | 12/2016 | van Boeyen et al. | |
| 10,408,204 | B2 | 9/2019 | Suzuki | |
| 10,408,207 | B2 | 9/2019 | Yamada et al. | |
| 10,480,296 | B2 | 11/2019 | Beisel | |
| 10,895,254 | B2 | 1/2021 | Beisel | |
| 10,947,967 | B1 | 3/2021 | Surjaatmadja et al. | |
| 11,125,225 | B2 | 9/2021 | Beisel | |
| 11,268,502 | B2 | 3/2022 | Mollatt | |
| 11,286,920 | B2 | 3/2022 | Mollatt | |
| 11,346,336 | B2 | 5/2022 | Surjaatmadja et al. | |
| 11,401,792 | B2 | 8/2022 | Mollatt | |
| 11,415,123 | B2 | 8/2022 | Hunter et al. | |
| 2003/0031565 | A1 | 2/2003 | Kleibrink | |
| 2006/0008364 | A1 | 1/2006 | Traylor | |
| 2007/0065305 | A1 * | 3/2007 | Budde | F04B 53/1002 417/395 |
| 2007/0074872 | A1 | 4/2007 | Du et al. | |
| 2008/0145248 | A1 * | 6/2008 | Kato | F04B 43/113 417/464 |
| 2009/0041588 | A1 * | 2/2009 | Hunter | F04B 7/0076 417/27 |
| 2012/0091165 | A1 * | 4/2012 | Cedrone | F04B 43/02 222/1 |
| 2012/0308409 | A1 | 12/2012 | Levine | |
| 2015/0148919 | A1 | 5/2015 | Watson | |
| 2016/0097384 | A1 * | 4/2016 | Menjoh | F04B 53/16 417/443 |
| 2016/0123313 | A1 | 5/2016 | Simmons | |
| 2018/0313196 | A1 | 11/2018 | Frantz, III et al. | |
| 2019/0383279 | A1 | 12/2019 | Simmons et al. | |
| 2020/0217186 | A1 * | 7/2020 | Mollatt | F04B 9/00 |
| 2020/0256333 | A1 | 8/2020 | Surjaatmadja et al. | |
| 2020/0277951 | A1 | 9/2020 | Hunter et al. | |
| 2020/0309113 | A1 | 10/2020 | Hunter et al. | |
| 2021/0140294 | A1 | 5/2021 | Mollatt | |
| 2021/0148354 | A1 | 5/2021 | Adams | |
| 2021/0173111 | A1 | 6/2021 | Therrien et al. | |
| 2021/0190065 | A1 | 6/2021 | Ferden et al. | |
| 2021/0246894 | A1 | 8/2021 | Mollatt | |
| 2022/0178368 | A1 | 6/2022 | Montilla Jimenez et al. | |
| 2024/0376809 | A1 * | 11/2024 | Hurst | E21B 43/129 |
| 2024/0376881 | A1 * | 11/2024 | Hurst | F04B 43/0054 |
| 2024/0376887 | A1 * | 11/2024 | Hurst | F04B 1/053 |
| 2025/0163784 | A1 | 5/2025 | Clyburn et al. | |

FOREIGN PATENT DOCUMENTS

| | | | | |
|---|---|---|---|---|
| CN | 106761573 | B | 4/2019 | |
| DE | 596227 | C | 7/1934 | |
| DE | 2253288 | A1 | 5/1974 | |
| DE | 3706338 | A1 | 9/1988 | |
| EP | 1602830 | A1 | 7/2005 | |
| EP | 2913525 | A1 | 2/2015 | |
| EP | 4286688 | A1 | 6/2023 | |
| FR | 1441747 | A | 6/1966 | |
| FR | 2367203 | A2 | 5/1978 | |
| GB | 2185291 | A | 7/1987 | |
| JP | H11159464 | A | 6/1999 | |
| JP | 2006200464 | B2 | 8/2006 | |
| JP | 2007100663 | A | 4/2007 | |
| KR | 1020170016059 | A | 8/2018 | |
| SU | 1359482 | A1 | 12/1987 | |
| WO | WO 2015078487 | A1 | 6/2015 | |
| WO | 2022099219 | A1 | 5/2022 | |
| WO | WO-2022164034 | A1 * | 8/2022 | F04B 43/0072 |

OTHER PUBLICATIONS

Filing Receipt, Specification and Drawings for U.S. Appl. No. 18/398,858, filed Dec. 28, 2023, entitled "Bellows Failure Detection for a Pump," 70 pages.

Filing Receipt, Specification and Drawings for U.S. Appl. No. 18/398,878, filed Dec. 28, 2023, entitled "Direct Connect Piston-Driven Bellows Pump," 96 pages.

Filing Receipt, Specification and Drawings for U.S. Appl. No. 18/398,885, filed Dec. 28, 2023, entitled "Improved Cooling for Bellows Pump," 80 pages.

Filing Receipt, Specification and Drawings for U.S. Appl. No. 18/398,905, filed Dec. 28, 2023, entitled "Valve Monitoring System for a Bellows Pump," 91 pages.

Filing Receipt, Specification and Drawings for U.S. Appl. No. 18/398,923, filed Dec. 28, 2023, entitled "Active Bellows Pump Valve Management," 81 pages.

Foreign Communication from Related Application—International Search Report and Written Opinion of the International Searching Authority, International Application No. PCT/US2023/086392, dated Apr. 19.2024, 11 pages.

Filing Receipt, Specification and Drawings for U.S. Appl. No. 18/398,936, filed Dec. 28, 2023, entitled "Systems and Methods Using a Bellows Pump to Perform Operations for a Subterranean Formation," 81 pages.

First Office Action dated Mar. 12, 2025 (8 pages), U.S. Appl. No. 18/398,936, filed Dec. 28, 2023.

Foreign Communication from Related Application—International Search Report and Written Opinion of the International Searching Authority, International Application No. PCT/US2023/086404, dated Apr. 24, 2024, 10 pages.

Foreign Communication from Related Application—International Search Report and Written Opinion of the International Searching Authority, International Application No. PCT/US2023/086394, dated Apr. 24, 2024, 11 pages.

Foreign Communication from Related Application—International Search Report and Written Opinion of the International Searching Authority, International Application No. PCT/US2023/086395, dated Apr. 30, 2024, 11 pages.

Foreign Communication from Related Application—International Search Report and Written Opinion of the International Searching Authority, International Application No. PCT/US2023/086389, dated May 1, 2024, 11 pages.

Foreign Communication from Related Application—International Search Report and Written Opinion of the International Searching Authority, International Application No. PCT/US2023/086385, dated May 7, 2024, 11 pages.

(56) References Cited

OTHER PUBLICATIONS

Foreign Communication from Related Application—International Search Report and Written Opinion of the International Searching Authority, International Application No. PCT/US2023/086397, dated May 7, 2024, 10 pages.
First Office Action dated Apr. 28, 2025 (45 pages), U.S. Appl. No. 18/398,878, filed Dec. 28, 2023.
First Office Action dated Jun. 2, 2025 (44 pages), U.S. Appl. No. 18/399,058, filed Dec. 28, 2023.
First Office Action dated Jun. 23, 2025 (47 pages), U.S. Appl. No. 18/399,058, filed Dec. 28, 2023.
First Office Action dated Jul. 2, 2025 (40 pages), U.S. Appl. No. 18/398,905, filed Dec. 28, 2023.

* cited by examiner

ACTIVE BELLOWS PUMP VALVE MANAGEMENT

CROSS-REFERENCE TO RELATED APPLICATIONS

This application claims priority benefit under 35 U.S.C. 119(e) of U.S. Provisional Patent Application Ser. No. 63/501,995 (filed May 12, 2023), which is incorporated by reference herein in its entirety.

STATEMENT REGARDING FEDERALLY SPONSORED RESEARCH OR DEVELOPMENT

Not applicable.

FIELD

This disclosure relates generally to the field of pumping, for example pumping of fluids downhole in a well. More particularly, this disclosure relates to systems and methods relating to bellows pumps.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), treatment, such as a stimulation operation, may be performed to enhance hydrocarbon production into the wellbore. Examples of some common stimulation operations involve hydraulic fracturing, acidizing, fracture acidizing, and hydro-jetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a treatment/stimulation fluid (which may comprise a clean fluid and a proppant) may be mixed at the surface before being pumped downhole in order to induce fractures or perforations in the formation of interest. The creation of such fractures or perforations will increase the production of hydrocarbons by increasing the flow paths into the wellbore.

Various types of pumps have been used in well operations such as hydraulic fracturing. However, given the difficult conditions and related wear and reliability issues that may arise when pumping treatment fluids for a hydrocarbon well, there is need for improved pumps and related systems and methods.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
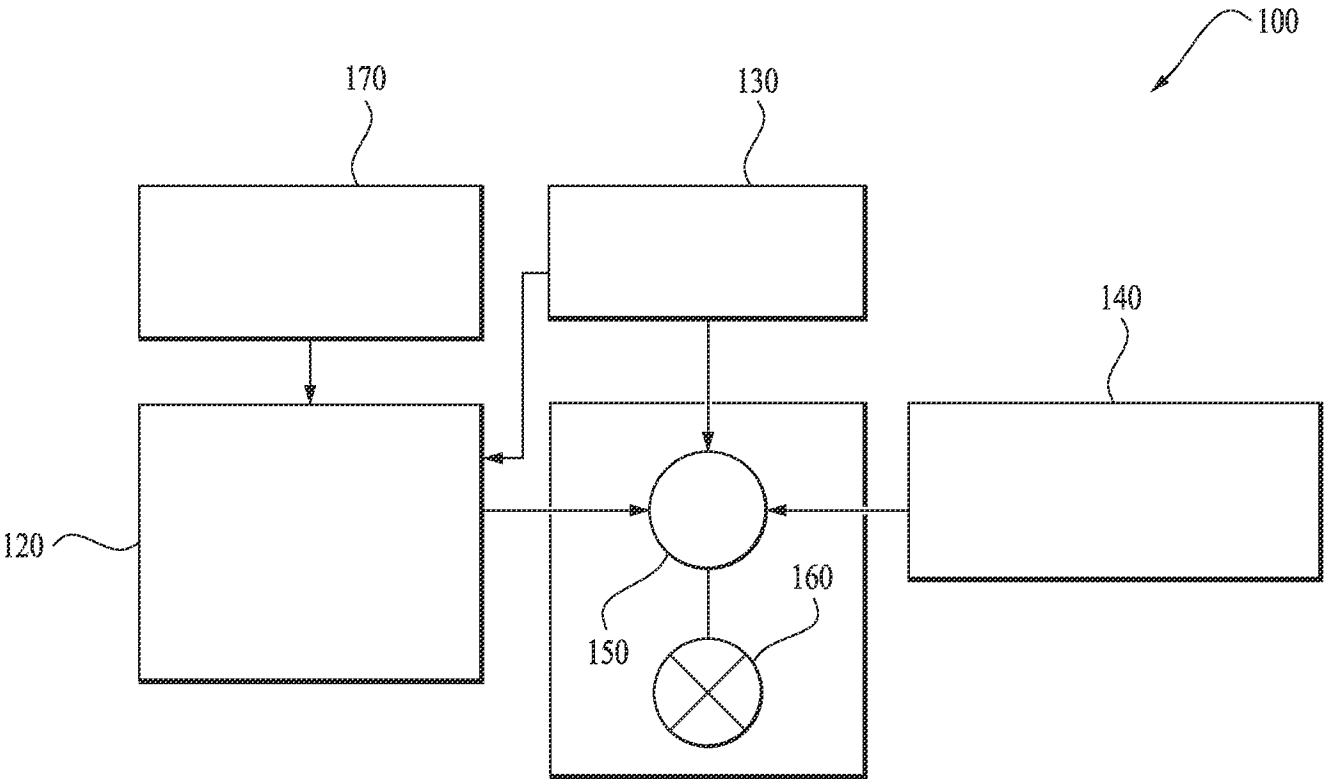
FIG. 1 is a schematic illustration of an exemplary well treatment system, such as an exemplary fracturing system, according to an embodiment of the disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Disclosed embodiments illustrate exemplary devices, systems, and methods for using treatment fluids to carry out subterranean treatments in conjunction with a variety of subterranean operations, including but not limited to, hydraulic fracturing operations, fracturing acidizing operations to be followed with proppant hydraulic fracturing operations, stimulation treatments, drilling, cementing, and the like. For example, treatment fluid may be introduced into a wellbore (e.g. which penetrates a subterranean formation) at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiment, a treatment fluid may be introduced at a pressure sufficient to create or enhance one or more fractures within the formation, and/or one or more of the treatment fluids may include a proppant material which subsequently may be introduced into the formation. In embodiments, treatment fluid can be any fluid (and may in some instances include solid particles therein) which can be pumped into a well. In embodiments, treatment fluid may differ from drive fluid used within a pump mechanism.

By way of example, FIG. 1 schematically illustrates an exemplary fracturing system 100. The fracturing system 100 may be implemented using the systems, methods, and techniques described herein. In particular, the disclosed systems, methods, and techniques may directly or indirectly affect one or more components or pieces of equipment associated with the example fracturing system 100, according to one or more embodiments. In embodiments, the fracturing system 100 may comprise one or more of the following: a fracturing fluid producing apparatus 120, a fluid source 130, a solid source 140, an additive source 170, and a pump and blender system 150. All or an applicable combination of these components of the fracturing system 100 may reside at the surface at a well site/fracturing pad where a well 160 can be located.

During a fracturing job, the fracturing fluid producing apparatus 120 may access the fluid source 130 for introducing/controlling flow of a fluid, e.g. a treatment fluid such as fracturing fluid, in the fracturing system 10. While only a single fluid source 130 is shown, the fluid source 130 may include a plurality of separate fluid sources (e.g. storage tanks). In some embodiments, the fracturing fluid producing apparatus 120 may be omitted from the fracturing system 100, with the fracturing fluid instead being sourced directly from the fluid source 130 during a fracturing job rather than through the intermediary fracturing fluid producing apparatus 120.

The fracturing fluid may be an applicable fluid for forming fractures during a fracture stimulation treatment of the well 160. For example, the fracturing fluid may include water, a hydrocarbon fluid, a polymer gel, foam, air, wet gases, and/or other applicable fluids. In various embodiments, the fracturing fluid may include a concentrate to which additional fluid is added prior to use in a fracture stimulation of the well 160. In certain embodiments, the fracturing fluid may include a gel pre-cursor with fluid, e.g. liquid or substantially liquid, from fluid source 130. Accordingly, the gel pre-cursor with fluid may be mixed by the fracturing fluid producing apparatus 120 to produce a hydrated fracturing fluid for forming fractures.

The solid source 140 may include a volume of one or more solids which may be mixed with a fluid, e.g. the fracturing fluid, to form a solid-laden fluid. The solid-laden fluid may be pumped into the well 160 as part of a solid-laden fluid stream that is used to form and stabilize fractures in the well 160 during a fracturing job. The one or more solids within the solid source 140 may include applicable solids that may be added to the fracturing fluid of the fluid source 130. Specifically, the solid source 140 may contain one or more proppants for stabilizing fractures after they are formed during a fracturing job, e.g. after the fracturing fluid flows out of the formed fractures. For example, the solid source 140 may contain sand.

The fracturing system 100 may also include an additive source 170. The additive source 170 may contain/provide one or more applicable additives that may be mixed into fluid, e.g. the fracturing fluid, during a fracturing job. For example, the additive source 170 may include solid-suspension-assistance agents, gelling agents, weighting agents, and/or other optional additives to alter the properties of the fracturing fluid. The additives may be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives may function to maintain solid particle suspension in a mixture of solid particles and fracturing fluid as the mixture is pumped down the well 160 to one or more perforations.

The pump and blender system 150 functions to pump treatment fluid into the well 160. Specifically, the pump and blender system 150 of FIG. 1 may pump fracture fluid from the fluid source 130, e.g. fracture fluid that is received through the fracturing fluid producing apparatus 120, into the well 160 for forming and potentially stabilizing fractures as part of a fracture job. The pump and blender system 150 may include one or more pumps. Specifically, the pump and blender system 150 may include a plurality of pumps that may operate together, e.g. concurrently, to form fractures in a subterranean formation as part of a fracturing job. The one or more pumps included in the pump and blender system 150 may be any applicable type of fluid pump. For example, the pumps in the pump and blender system 150 may include electric pumps and/or hydrocarbon and hydrocarbon mixture powered pumps, such as diesel-powered pumps, natural gas-powered pumps, and diesel combined with natural gas-powered pumps. In one or more embodiments, one or more of the pumps in the pump and blender system 150 may be a bellows pump.

In some embodiments, the pump and blender system 150 may also function to receive the fracturing fluid and combine it with other components and solids (e.g. with the pump and blender system 150 optionally comprising a blender unit). Specifically, the pump and blender system 150 may combine the fracturing fluid with volumes of solid particles, e.g. proppant, from the solid source 140 and/or additional fluid and solids from the additive source 170. In turn, the pump and blender system 150 may pump the resulting mixture down the well 160 at a sufficient pumping rate to create or enhance one or more fractures in a subterranean zone, for example, to stimulate production of fluids from the zone. While the pump and blender system 150 is described to perform both pumping and mixing of fluids and/or solid particles, in various embodiments, the pump and blender system 150 may function to just pump a fluid stream, e.g. a treatment and/or fracture fluid stream, down the well 160 to create or enhance one or more fractures in a subterranean zone. In some embodiments, a separate pump and/or separate blender may be used (e.g. independently of each other or alone).

In embodiments, one or more elements/components of the system may be monitored (e.g. using one or more sensor). For example, the fracturing fluid producing apparatus 120, fluid source 130, and/or solid source 140 may be equipped with one or more monitoring devices (not shown). The monitoring devices may be used to control the flow of fluids, solids, and/or other compositions to the pumping and blender system 150. Such monitoring devices may effectively allow the pumping and blender system 150 to source from one, some, or all of the different sources at a given time. In turn, the pumping and blender system 150 may provide just fracturing fluid into the well 160 at some times, just solids or solid slurries at other times, and combinations of those components at other times.

Figure 2:
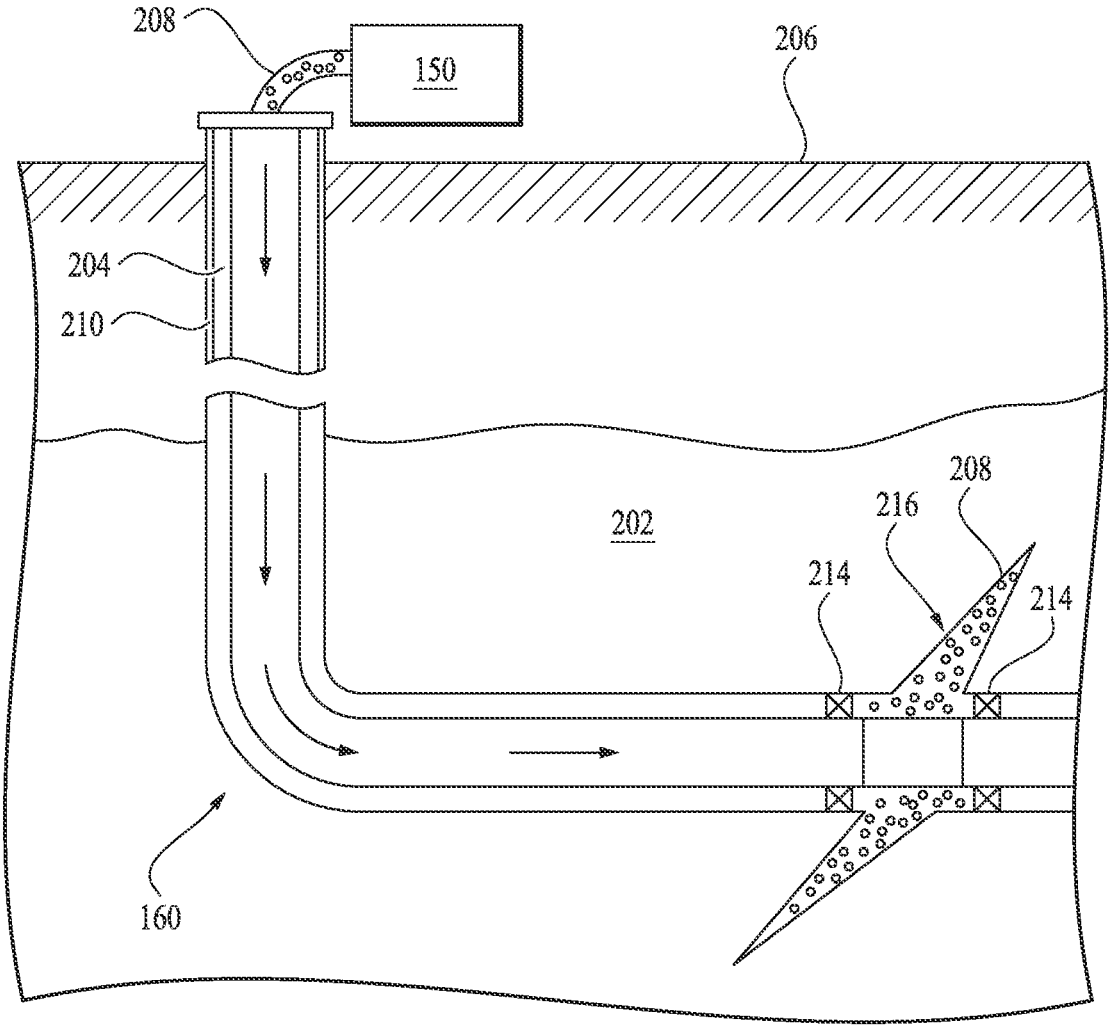
FIG. 2 is a schematic illustration of an exemplary well during a treatment operation, according to an embodiment of the disclosure.

FIG. 2 illustrates an exemplary well 160 during a treatment operation (e.g. a fracturing operation) in a portion of a subterranean formation of interest 202 surrounding a wellbore 204. In embodiments, the downhole operation may be performed using one or an applicable combination of the components in the example system 100 shown in FIG. 1. The wellbore 204 of FIG. 2 extends from a surface 206, and a fracturing fluid 208 is applied to a portion of the subterranean formation 202 (e.g. surrounding the horizontal portion of the wellbore 204). Although shown as vertical deviating to horizontal, the wellbore 204 may include horizontal, vertical, slant, curved, and other types of wellbore geometries and orientations, and the fracturing treatment may be applied to a subterranean zone surrounding any portion of the wellbore 204. The wellbore 204 may include a casing 210 that is cemented or otherwise secured to the wellbore wall. The wellbore 204 may be uncased or otherwise include uncased sections. Perforations may be formed in the casing 210 to allow fracturing fluids and/or other materials to flow into the subterranean formation 202. In the example fracture operation shown in FIG. 2, a perforation is created between points 214 (which may represent one or more packer element in some embodiments) defining an isolated zone.

The pump and blender system 150 (or in some embodiments, just a pump or a separate pump and a separate blender) may be fluidly coupled to the wellbore 204 to pump treatment fluid (e.g. fracturing fluid 208), and potentially other applicable solids and solutions, into the wellbore 204. When the fracturing fluid 208 is introduced into wellbore 204, it may flow through at least a portion of the wellbore 204 to the perforation, for example defined by points 214 in FIG. 2. The fracturing fluid 208 may be pumped at a sufficient pumping rate through at least a portion of the wellbore 204 to create one or more fractures 216 through the perforation and into the subterranean formation 202. Specifically, the fracturing fluid 208 may be pumped at a sufficient pumping rate to create a sufficient hydraulic pressure at the perforation to form the one or more fractures 216. Further, solid particles, e.g. proppant from the solid source 140, may be pumped into the wellbore 204, e.g. within the fracturing fluid 208 towards the perforation. In turn, the solid particles may enter the fractures 216 where they may remain after the fracturing fluid flows out of the wellbore. These solid particles may stabilize or otherwise "prop" the fractures 216, such that fluids may flow freely through the fractures 216.

While only two perforations at opposing sides of the wellbore 204 are shown in FIG. 2, greater than two perforations may be formed in the wellbore 204 as part of a perforation cluster. Fractures may then be formed through the plurality of perforations in the perforation cluster as part of a fracturing stage for the perforation cluster. Specifically, fracturing fluid and solid particles may be pumped into the wellbore 204 and pass through the plurality of perforations during the fracturing stage to form and stabilize the fractures through the plurality of perforations.

The pump and blender system 150 may comprise a pump (e.g. a high-pressure pump), which may be used, either alone or in combination with one or more other pumps, to pressurize a treatment fluid and/or introduce the treatment fluid into wellbore 204 penetrating at least a portion of a subterranean formation to perform a treatment therein. For example, in hydraulic fracturing operations, one or more pumps may be used to pump a treatment fluid (e.g. fracturing fluid 208, which typically may be a slurry mixture of proppant and/or sand mixed with water) into the formation.

Figure 3:
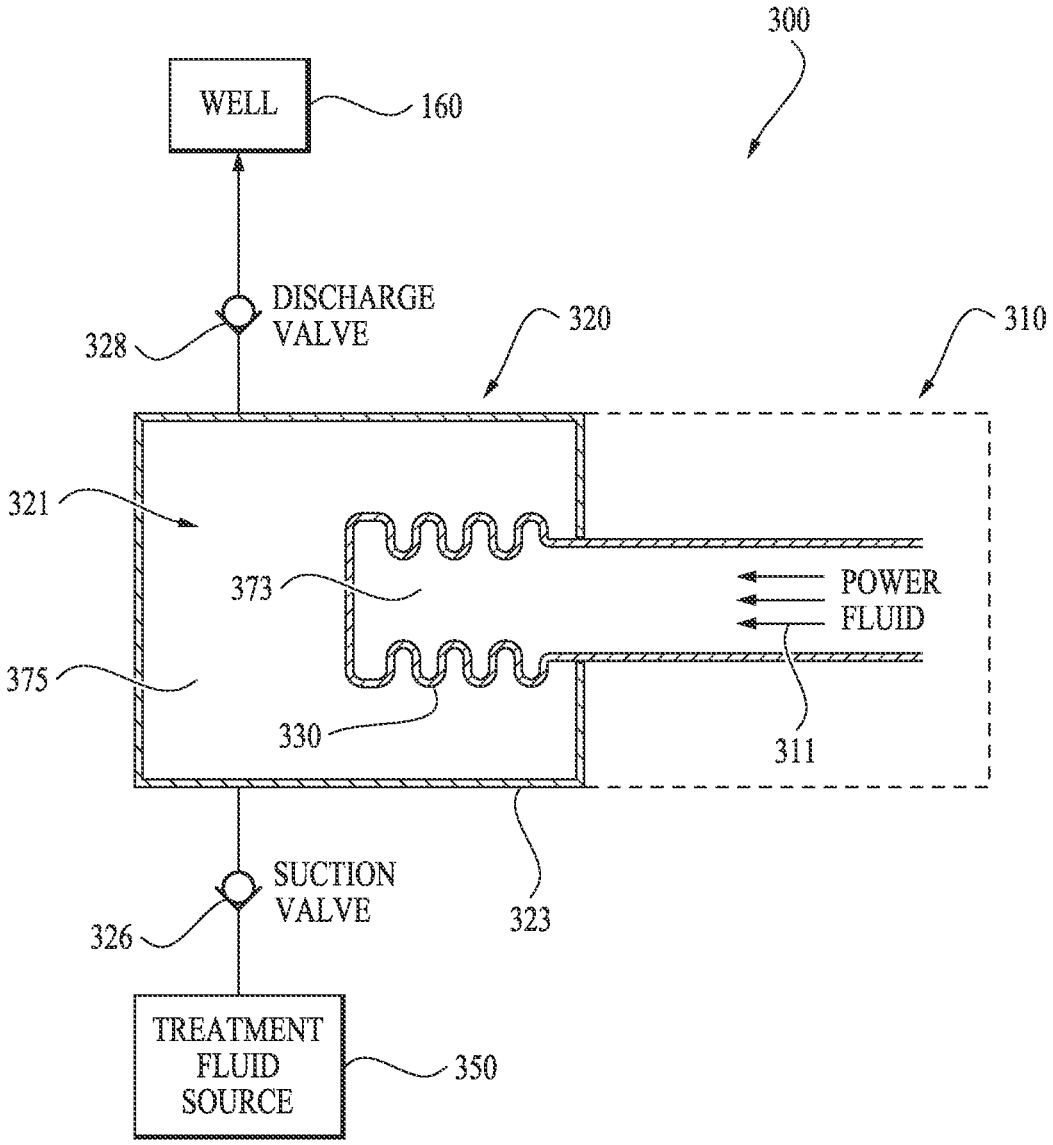
FIG. 3 is a schematic illustration of an exemplary bellows pump, according to an embodiment of the disclosure.

In some embodiments, the pump may comprise a bellows pump 300, which may be configured to segregate treatment fluid from drive fluid (sometimes termed power fluid). See for example FIG. 3, which schematically illustrates a bellows pump 300. The bellows pump 300 may comprise a power end 310, a fluid end 320, and an expandable bellows 330. The fluid end 320 may have a chamber 321 within a fluid end housing 323, a suction valve 326 in fluid communication with (e.g. fluidly coupled to) the chamber 321 and a source/reservoir for the treatment fluid 350 (e.g. with the suction valve 326 being configured to allow for insertion of treatment fluid into the chamber 321), and a discharge valve 328 in fluid communication with (e.g. fluidly coupled to) the chamber 321 and the well (e.g. with the discharge valve 328 being configured to allow for insertion of treatment fluid from the chamber 321 into the well or any other place where treatment fluid is intended to be pumped). While the suction valve 326 and discharge valve 328 may be disposed within the housing 323 for the fluid end 320 in some embodiments, in other embodiments, the suction valve 326 and discharge valve 328 may be located within other components (such as piping) that fluidly couples the valves to the elements/components of the pump 300 as described.

In embodiment, the power end 310 may be fluidly connected to (e.g. in fluid communication with) the bellows 330 (e.g. the inner volume of the bellows) and/or configured to reciprocally expand/inflate and contract/deflate the bellows 330 based on movement of drive fluid 311 (sometimes termed power fluid). The bellows 330 may be configured to reciprocally expand and/or retract within the chamber 321 of the fluid end 320 based on movement of the drive fluid 311. In some embodiments, the bellows 330 may be sealingly coupled to an opening in the chamber 321 of the fluid end 320 (e.g. coupled to the wall of the chamber), so that fluid communication between the power end 310 and the bellows 330 causes reciprocal movement of the bellows 330 within the chamber 321. In some embodiments, the power end 310 may be (e.g. sealingly) coupled to the fluid end 320, with no flow of treatment fluid or drive fluid therebetween (e.g. since the bellows 330 separates the fluids).

In embodiments, the bellows 330 may comprise a flexible/expandable bag or body, typically of thin, flexible material, whose inner volume (e.g. the open space therein, which may be configured to hold drive fluid) can be changed (e.g. based on the amount/pressure of fluid therein). The bellows 330 may have an opening allowing fluid communication of drive fluid 311 with the power end 310, but in some embodiments may otherwise have a form configured to retain fluid therein. For example, the bellows 330 may be configured to prevent fluid transfer between its interior and the chamber 321 of the fluid end 320 external to the bellows 330. In some embodiments, the bellows 330 may comprise an elastomeric element and/or material. In some embodiments, the bellows 330 may comprise metal material and/or may include an accordion-like configuration (e.g. having pleats or folds or convolutions). In some embodiments, exemplary metal bellows may be formed of a metal that is sufficiently flexible and/or durable and configured appropriately to effectively withstand repeated back and forth motion due to reciprocal movement without breaking or wearing to failure for a reasonable life of the bellows. For example, the bellows may comprise stainless steel, nickel alloys such as Inconel & Monel, hastealloy, and/or copper alloys. In some embodiments, the bellows 330 may not be configured to withstand significant pressure differentials. In some embodiments, the bellows 330 may be configured to separate (e.g. isolate) drive fluid 311 (e.g. clean fluid) from treatment fluid (e.g. dirty fluid, such as fluid having proppant, abrasives, and/or corrosive materials, such as from treatment fluid source 350).

The bellows 330 may be disposed in and/or configured to expand into the chamber 321 of the fluid end 320, and may be configured to serve as a separating barrier that divides the chamber 321 into a first volume 373 within the bellows 330 and a second volume 375 outside of the bellows 330. The first volume 373 (e.g. inner volume of the bellows 330) may be in fluid communication with the power end 310, and may in some embodiments contain drive fluid. The second volume 375 of the chamber 321 is in fluid communication with the suction valve 326 and discharge valve 328, and is configured for treatment fluid to flow therethrough. The bellows 330 may serve as a fluid separating barrier between the drive fluid 311 in the first volume 373 and the treatment fluid in the second volume 375. The bellows 330 may be configured to flex (e.g. expand and/or contract) to balance pressure between the first volume 373 and second volume 375 during operation of the pump 300. In some embodiments, the bellows 330 may be configured to flex axially. The power end 310 of pump 300 may be sealingly connected to the fluid end 320, to prevent entry of treatment fluid from the fluid end 320 into the power end 310.

The chamber 321 may be downstream of the fluid treatment source 350 and upstream of the well 160. Typically, the suction valve 326 can be a one-way check valve configured to allow treatment fluid from the treatment fluid source 350 to enter the chamber 321 (e.g. during a suction stroke of the pump 300), and the discharge valve 328 can be a one-way check valve configured to allow treatment fluid to exit the chamber 321 towards the well (e.g. during a power/discharge stroke of the pump 300). The reciprocating expansion and retraction of the bellows 330 in the chamber 321 (e.g. with the bellows 330 expanding/inflating for the discharge stroke and contracting/deflating for the suction stroke) can be configured to work in conjunction with the suction valve 326 and discharge valve 328 to allow the fluid end 320 to pump treatment fluid into the well 160. For example, during a discharge stroke, as drive fluid 311 enters the first volume 373 (e.g. the inner volume of the bellows 330), the bellows 330 inflates and treatment fluid is expelled from the second volume 375 of the chamber 321 through the discharge valve 328. Once the discharge stroke is complete, a suction stroke can begin. During the suction stroke, drive fluid 311 inside the first volume 373 exits the bellows 330, the bellows 330 deflates, and treatment fluid can be drawn through the suction valve 326 into the second volume 375 of the chamber 321. Once the bellows 330 is compressed to its minimum desired/permitted length, another discharge stroke can begin.

The bellows 330 may be configured to separate treatment fluid, which the pump 300 may be pumping into the well 160, from drive fluid 311 used for pump operations. By way of example, the drive fluid 311 may be chosen from a desirable group of liquids, which may include hydraulic fluid such as water or hydraulic oil. In some embodiments, the drive fluid 311 may also serve as a lubricant for the pump 300, for example forming a barrier against wear due to friction. In the case of a fracturing operation or a fracturing pump, the treatment fluid may be a fracturing fluid that may comprise a base fluid (e.g., water, oils, organic liquids, etc.) as well as any other suitable components or additives useful for the fracturing treatment. For example, the fracturing fluid may be a slurry containing sand or synthetic proppants and/or a variety of chemical additives such as gelling agents, acids, friction reducers, and solvents.

In various embodiments, any mechanism for causing reciprocal movement of the bellows 330 (e.g. by movement of the drive fluid 311) can provide the pumping action for the pump 300. In some embodiments, the power end 310 may further comprise a piston or plunger 410 configured to reciprocally move drive fluid 311 (e.g. in and out of the bellows 330). See for example FIG. 4, which schematically illustrates an embodiment of the bellows pump 300 having a piston/plunger 410. Reciprocal movement (e.g. axial translation) of the piston/plunger 410 within a bore 420 of the power end housing 413 may cause the reciprocal movement (e.g. expanding and contracting) of the bellows 330 (e.g. within the chamber 321 of the fluid end 320), for example with the piston/plunger 410 displacing fluid (e.g. hydraulic drive fluid 311) which is located in the bore 420 between the driven end of the piston/plunger 410 (e.g. the end in proximity to the bellows 330) and the bellows 330. Since the bore 420 is fluidly coupled to (e.g. in fluid communication with) the bellows 330, the piston/plunger 410 reciprocally displacing drive fluid 311 can induce reciprocal movement (e.g. expansion and contraction) of the bellows 330. As used herein, reference to "piston" shall include both conventional piston and plunger elements for convenience of reference.

Figure 4:
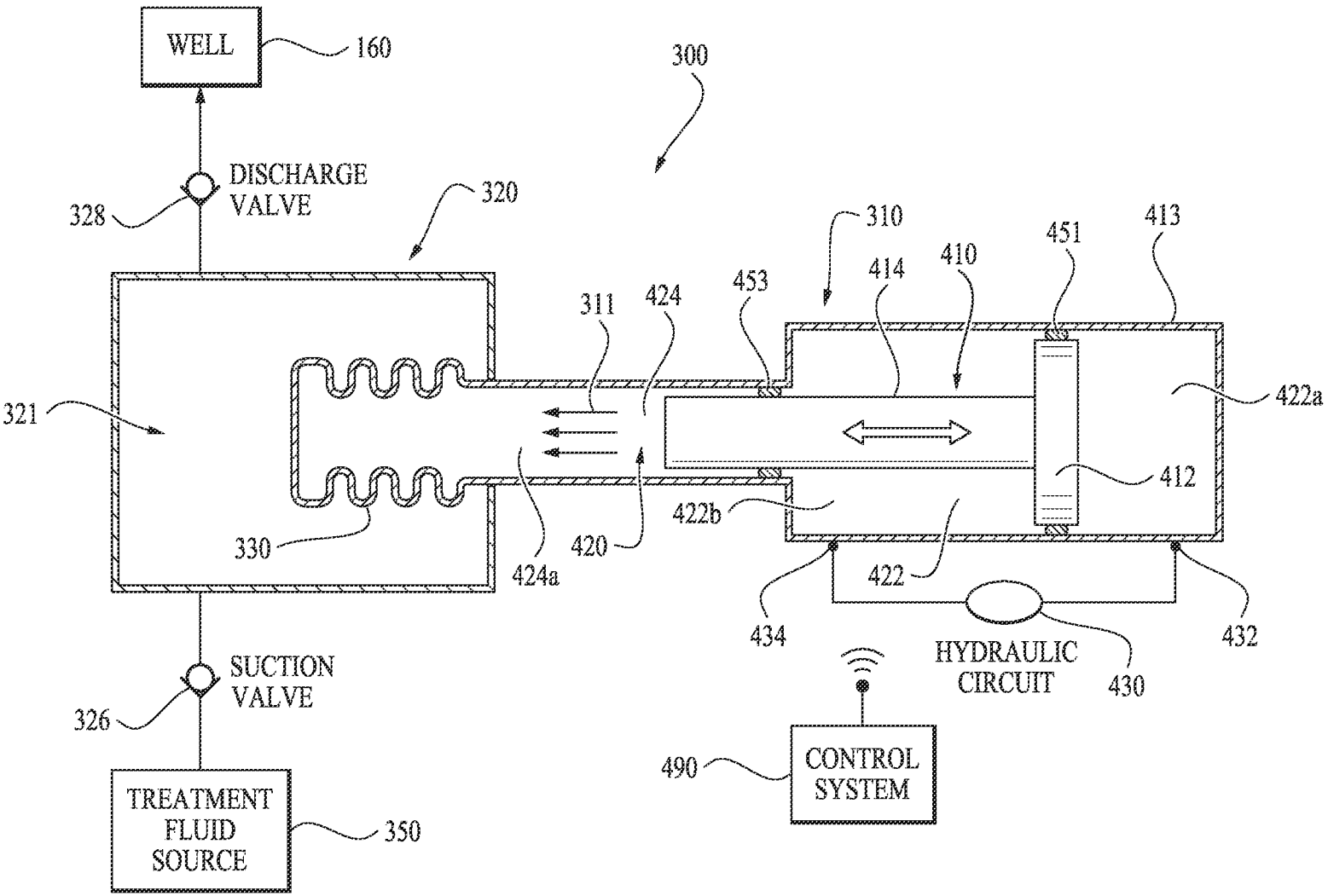
FIG. 4 is a schematic illustration of an exemplary bellows pump with piston/plunger, according to an embodiment of the disclosure.

In embodiments, the piston 410 may be configured to sealingly move within the bore 420, for example having one or more seal (configured to engage between the piston 410 and the bore 420) disposed on the piston 410 and/or on the inner wall of the bore 420. In some embodiments, one or more seal may comprise pump packing. In some embodiments, the bellows 330 may be configured to protect the piston 410 from wear, for example by separating the piston 410 from the treatment fluid in the fluid end 320. In some embodiments, the piston 410 may be configured so that, during its reciprocal movement in the bore 420, the piston 410 does not extend into the inner volume of the bellows 330; while in other embodiments, the piston 410 may be configured to extend partially into the bellows during a discharge stroke. Regardless, the piston 410 may be configured to not contact the bellows 330 (e.g. the end of the bellows) during its reciprocal movement. The piston 410 can be driven/powered by any suitable means, including various types of driver elements configured to induce reciprocal movement of the piston 410, such as a hydraulic circuit, a combustion engine, an electric motor, a linear actuator, rack and pinion, etc. In the example of FIG. 4, the piston 410 may be driven by a hydraulic circuit 430. In other exemplary embodiments, the pump 300 may be powered by natural gas (e.g. via a natural gas-fired engine or natural gas-fired electric generator) produced from the same area in which well treatment (e.g. fracturing) operations are being performed. In some embodiments, a control system 490 may control one or more aspect of the driver (e.g. to control the reciprocation of the piston 410 and thereby the bellows 330) and/or the valves (e.g. 326, 328).

In some embodiments, the piston 410 can comprise a head 412 and a rod 414 (e.g. with the rod 414 disposed between the head 412 and the bellows 330, and extending from the head 412 towards the fluid end 320). In some embodiments, the piston 410 can be driven by a hydraulic circuit 430. For example, the hydraulic circuit 430 of the power end 310 can include a first port 432, located such that the head 412 is disposed between the first port 432 and the rod 414, and a second port 434 located between the head 412 and the bellows 330 (e.g. more proximate the bellows 330 than the first port 432). In some embodiments, the hydraulic circuit 430 may include one or more source of drive fluid and/or one or more pump. For example, the first port 432 may be in fluid communication with a source of drive fluid and/or a pumping mechanism. In some embodiments, the second port 434 may be in fluid communication with a source of drive fluid and/or a pumping mechanism. In some embodiments, the source of drive fluid may be the same for the first port 432 and the second port 434. In some embodiments, the pumping mechanism may be the same for the first port 432 and the second port 434. In some embodiments, the hydraulic circuit 430 may include one or more valve. The hydraulic circuit 430 may be configured to produce pressure differential on either side of the piston 410 (e.g. the head 412), for example by introducing drive fluid (such as hydraulic oil) via the ports (432, 434), which may induce movement/displacement of the piston 410. For example, introducing drive fluid via the first port 432 and/or removing drive fluid via the second port 434 may urge extension of the piston 410 towards the fluid end 320, while introducing drive fluid via the second port 434 and/or removing drive fluid via the first port 432 may retract the piston 410, urging the piston 410 away from the fluid end 320.

While the rod 414 and head 412 may have a similar diameter in some embodiments, in some embodiments the rod 414 may have a smaller diameter than the head 412. The ratio of size differential between the rod 414 and the head 412 can provide an intensifying effect, in which pressure applied to the head 412 is multiplied/increased as applied to the bellows 330 (via the rod 414). For example, the piston 410 may be part of an intensifier configured to intensify applied pressure (e.g. from the driver) to the bellows 330 (e.g. with the rod 414 having a smaller diameter than the head 412). For example, the size difference/ratio between the diameter of the rod 414 and the head 412 may range from approximately 1:1.1 to 1:10 (e.g. from 1:1.5 to 1:10, from 1:2 to 1:10, from 1:3 to 1:10, from 1:5 to 1:10, from 1:7 to 1:10, from 1:1.5 to 1:8, from 1:1.5 to 1:5, from 1:1.5 to 1:3, from 1:2 to 1:8, from 1:2 to 1:5, from 1:2 to 1:3, from 1:3 to 1:10, from 1:3 to 1:8, or from 1:3 to 1:5).

As described above, the power end 310 may include a bore 420 (e.g. in a power end housing 413) in fluid communication with (e.g. fluidly coupled to) the bellows 330 (e.g. an internal volume of the bellows), and the piston 410 can be disposed within the bore 420. In embodiments (e.g. in which the piston 410 is not uniform in diameter along its length), the bore 420 may have a first portion 422 with an inner diameter configured for movement of the head 412 (axially) therethrough and a second portion 424 with an inner diameter configured for movement of the rod 414 (axially) therethrough. For example, the first portion 422 of the bore may have a diameter approximately equal to that of the head 412, while the second portion 424 of the bore may have a diameter approximately equal to that of the rod 414 (e.g. the first portion 422 of the bore may have a larger diameter than the second portion 424 of the bore). In embodiments, the head 412 may separate the first portion 422 of the bore 420 into two cavities (whose volumes may change based on the position of the head 412 within the bore 420), for example with a first cavity 422*a* distally away from the fluid end 320 and/or bellows 330 (e.g. with the head 412 disposed between the first cavity 422*a* and the bellows 330) and a second cavity 422*b* more proximal to the bellows 330 and/or fluid end 320 (e.g. with the second cavity 422*b* disposed between the head 412 and the bellows 330). Interaction of the rod 414 within the second portion 424 of the bore 420 may form a third cavity 424*a* in fluid communication with the bellows 330. In embodiments having a hydraulic circuit as the driver (e.g. as shown in FIG. 4), the first port 432 may be in fluid communication with the first cavity 422*a*, and the second port 434 may be in fluid communication with the second cavity 422*b*. The third cavity 424*a* may be in fluid communication with the bellows 330. Typically, the bore 420 may extend along the longitudinal axis of the power end 310 and/or parallel to the longitudinal axis (e.g. the axis of extension) of the bellows 330.

In operation, the head 412 of the piston 410 may be configured to sealingly move within the first portion 422 of the bore 410 (e.g. during pump strokes), and the rod 414 may be configured to sealingly move within the second portion 424 of the bore 420 (e.g. during pump strokes). In embodiments, the power end 310 may further comprise a first seal 451 configured to seal the head 412 with respect to the first portion 422 of the bore 420 (e.g. such that the head 412 and first seal 451 isolate the first cavity 422*a* from the second cavity 422*b*) and a second seal 453 configured to seal the rod 414 with respect to the second portion 424 of the bore 420 (e.g. such that the rod 414 and second seal 453 isolate the third cavity 424*a* from the second cavity 422*b*). For example, the first seal 451 may be disposed on the head 412 (e.g. a moving seal), such as within one or more groove configured to hold a gasket, or on the bore first portion 422 inner surface (e.g. a stationary seal) and/or the second seal 453 may be disposed on the rod 414 (e.g. a moving seal) or on the bore second portion 424 inner surface (a stationary seal). In some embodiments, the first seal 451 may be a moving seal (e.g. disposed on the head 412) and the second seal 453 may be a stationary seal (e.g. disposed on the inner surface/wall of the bore 420—e.g. within the bore second portion 424—which may in some embodiments comprises pump packing). In some embodiments, one or more stationary seal may be configured to prevent fluid flow between the second portion 424 of the bore and the first portion 422 of the bore and/or to provide a controlled volume of fluid for interaction with the inner volume of the bellows 330. While the discussion has been set forth with regard to a pump 300 having a single bellows 330, similar concepts apply for dual (e.g. double-acting) bellows pumps (e.g. in which a single piston interacts with two bellows, for example such that the discharge stroke for one bellows is the suction stroke for the other).

It can be important for the health of the bellows pump 300 (e.g. to protect the bellows 330 from excessive pressure differentials which could damage the bellows 330) to ensure that the bellows 330 and the piston 410 remain in sync (e.g. with the bellows 330 not exceeding its full permissible extension position when the piston 410 is at its maximum extension at the end of the discharge stroke, and the bellows 330 not exceeding its permissible contraction position when the piston 410 is at its most retracted position at the end of its suction stroke). To aid in maintaining such synchronization between the bellows 330 and the piston 410, the volume of fluid between the rod 414 and the bellows 330 may be maintained at approximately a constant volume. Leaks in the bellows 330 can prove problematic, affecting the amount of sync and potentially damaging the bellows 330. For example, a bellows 330 leak can cause a pressure imbalance between the drive fluid in the bellows 330 and the treatment fluid in the chamber 321, which may damage (e.g. crush) the bellows 330.

Figure 5:
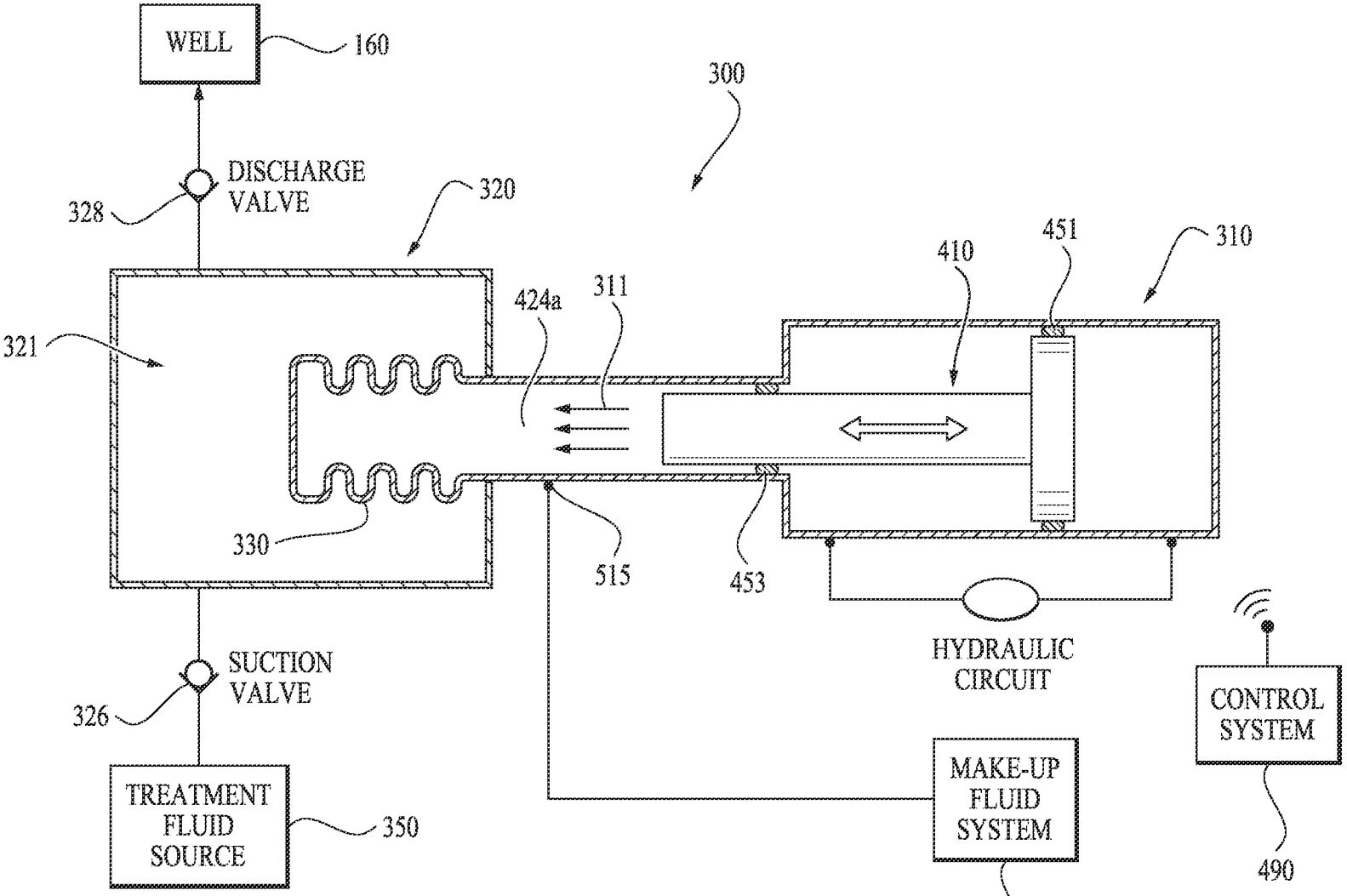
FIG. 5 is a schematic illustration of an exemplary system for providing make-up fluid to an exemplary bellows pump, according to an embodiment of the disclosure.

In order to address any such leak, a make-up system 510 (e.g. as shown schematically with an embodiment of pump 300 in FIG. 5) can be configured to correct/maintain a controlled volume of fluid in the space between the rod 414 and the bellows 330 (for example by injecting make-up fluid, which typically is drive fluid, into the space between the rod 414 and the bellows 330—e.g. into the sealed space formed by the rod seal 453, such as the third cavity 424*a*), in order to maintain synchronization between the bellows 330 and the piston 410. For example, the power end 310 may include a make-up port 515 (e.g. a third port), which may be in fluid communication with the second portion 424 of the bore 420 (e.g. the third cavity 424*a* between the rod 414 and/or rod seal 453 and the bellows 330). While the make-up port 515 is shown with respect to the power end 310 in FIG. 5, in other embodiments, the make-up port 515 may be disposed in the fluid end 320.

A source of make-up fluid may be in fluid communication with the make-up port 515, and the make-up system 510 may further comprise one or more make-up valve configured to open (to provide fluid communication therethrough) and close (to prevent fluid communication therethrough and/or isolate the make-up system 510 from the bellows 330). In some embodiments the make-up system 510 may include a make-up pump, which may be configured to pump make-up fluid from the make-up fluid source into the second portion 424 of the bore 420 through the make-up port 515. The control system 490 in some embodiments may be used to operate the make-up system 510, for example opening and closing the make-up valve and/or operating the make-up pump. In some embodiments, the control system 490 may comprise and/or communicate with one or more sensors, whose data the control system 490 can use to determine if the bellows 330 and piston 410 are out of sync and to operate the make-up system 510 to bring the bellows 330 and piston 410 back into sync. For example, the control system 490 may open the make-up valve and activate the make-up pump to inject make-up fluid into cavity 424*a* and/or to draw make-up fluid out of cavity 424*a* via make-up port 515, in order to bring the bellows 330 and the piston 410 back into sync.

In some embodiments, the pump 300 may be one of a plurality of similar pumps which may be configured to operate together/concurrently (e.g. configured to jointly pump fluid in the well 160 and/or which are jointly driven and/or which share a common drive fluid source and/or make-up fluid source and/or which are jointly controlled). For example, the plurality of pumps 330 may share a common source for treatment fluid, drive fluid, and/or make-up fluid. In some embodiments, the drive fluid and the make-up fluid may be drawn from a common fluid source (e.g. drive fluid and make-up fluid may be substantially the same). In some embodiments, the plurality of pumps 330 can share a common driver. In some embodiments, the plurality of pumps 330 may share a common control system 490. In some embodiments, one or more of the plurality of pumps 330 may be configured to be out-of-sync with one or more other of the plurality of pumps 330 (for example with a first pump undergoing a discharge stroke while a second pump undergoes a suction stroke). In some embodiments, having pumps of the plurality of pumps 330 out-of-sync with each other may allow for continuous pumping of treatment fluid (e.g. under approximately constant pressure). In some embodiments, a first half of the plurality of pumps may be in sync with each other, while a second half of the plurality of pumps may be in sync with each other but out of sync with the first half. In some embodiments, the plurality of pumps may comprise at least two dissimilar pumps.

Some embodiments may include a control system 490, which may be configured to monitor and/or control one or more aspects of the bellows pump 300 and/or related treatment system 100 (e.g. a system including at least one bellows pump 300). The control system 490 may include an information handling system (e.g. comprising one or more processor) and/or may be configured to receive data from one or more sensor configured to monitor/detect one or more parameters of the system. In some embodiments, the parameters monitored may include pressure, temperature, flow rate, viscosity, contamination/particle count, strain, valve position, piston position, and/or bellows position. Data from the sensor(s) may be transmitted to and/or received by the information handling system, for example with the control system 490 using the data to monitor and/or control one or more aspect of the bellows pump 300 and/or system 100. In embodiments, the control system 490 may be configured to communicate with sensors and/or other components of the pump or system wirelessly and/or via wired connection.

Figure 6:
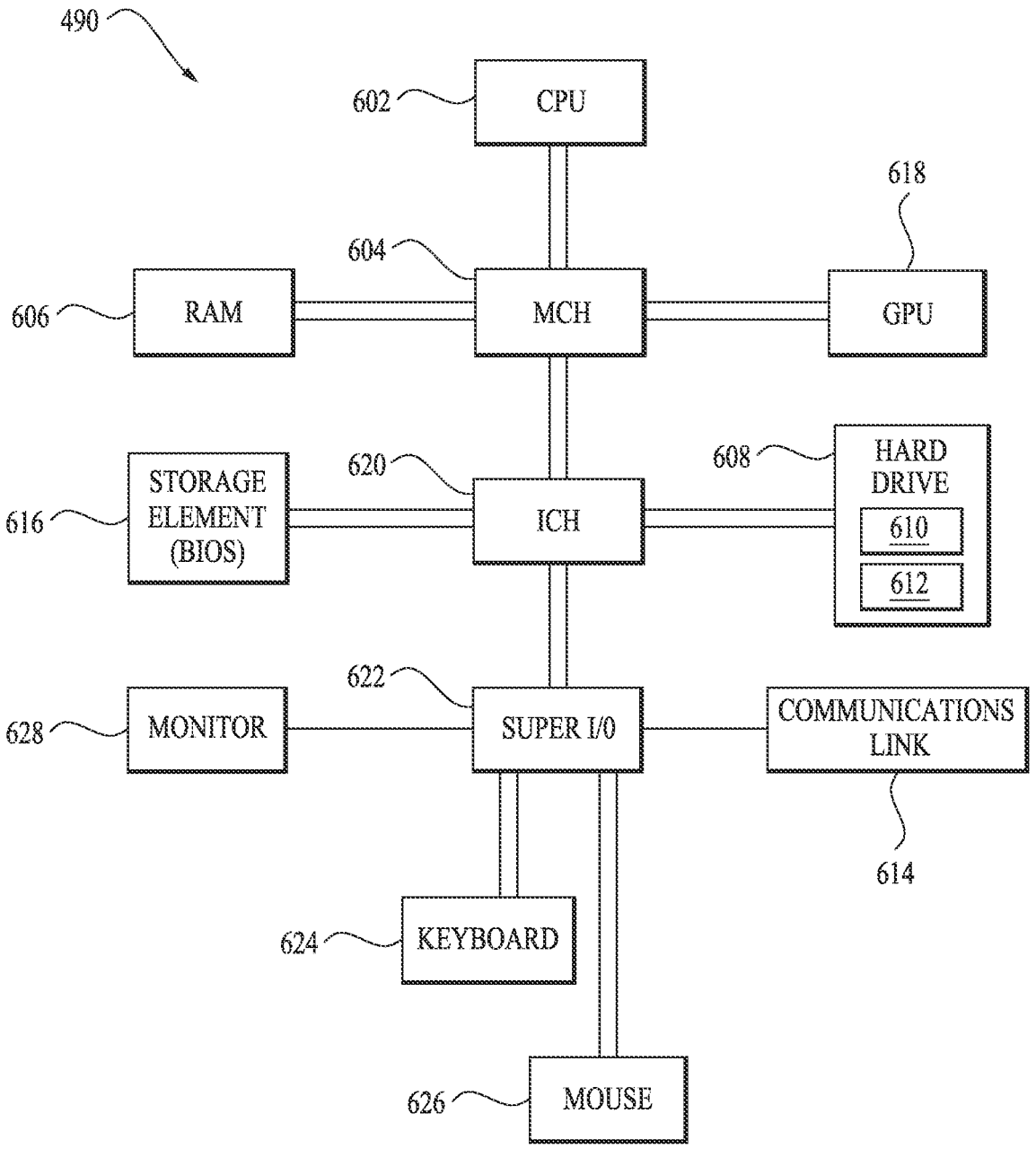
FIG. 6 is a schematic illustration of an exemplary control system, which may be used in conjunction with a bellows pump system, according to an embodiment of the disclosure.

FIG. 6 is a schematic diagram illustrating an exemplary information handling system/control system 490, for example for use with or by an associated treatment system 100 of FIG. 1, according to one or more aspects of the present disclosure. A processor or central processing unit (CPU) 602 of the control system 490 is communicatively coupled to a memory controller hub (MCH) or north bridge 604. The processor 602 may include, for example a microprocessor, microcontroller, digital signal processor (DSP), application specific integrated circuit (ASIC), or any other digital or analog circuitry configured to interpret and/or execute program instructions and/or process data. Processor 602 may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory 606 or hard drive 608. Program instructions or other data may constitute portions of a software or application, for example application 610 or data 612, for carrying out one or more methods described herein. Memory 606 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 610 or data 612 may be retrieved and stored in memory 606 for execution or use by processor 602. In one or more embodiments, the memory 606 or the hard drive 608 may include or comprise one or more non-transitory executable instructions that, when executed by the processor 602, cause the processor 602 to perform or initiate one or more operations or steps. The information handling system 600 may be preprogrammed or it may be programmed (and reprogrammed) by loading a program from another source (for example, from a CD-ROM, from another computer device through a data network, or in another manner).

The data 612 may include treatment data, geological data, fracture data, microseismic data, sensor data, or any other appropriate data. In one or more embodiments, the data 612 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 612 may include geological data relating to one or more geological properties of the subterranean formation 202 (referring to FIG. 2). For example, the geological data may include information on the wellbore 204 (referring to FIG. 2), completions, or information on other attributes of the subterranean formation 202. In one or more embodiments, the geological data may include information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 612 may include fracture data relating to fractures in the subterranean formation 202. The fracture data may identify the locations, sizes, shapes, and other properties of fractures in a model of a subterranean zone. The fracture data may include information on natural fractures, hydraulically-induced fractures, or any other type of discontinuity in the subterranean formation 202. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information.

In embodiments, the sensor data may include data measured/detected by one or more sensors, for example with relation to one or more aspect of the pump 300 and/or the system 100. For example, the sensor data may include pressure (e.g. at the fluid end 320 and/or the power end 310), temperature (e.g. at the fluid end 320 and/or power end 310 and/or make-up system 510), flow rate (e.g. within the fluid end 310 and/or hydraulic circuit 430 and/or the make-up system 510), viscosity (e.g. of treatment fluid in the fluid end 320 and/or drive fluid in the power end 310), contamination/particle count (e.g. at the fluid end 320 and/or power end 310 and/or in the make-up system 510), strain (e.g. at the fluid end 320 and/or power end 310), suction valve 326 and/or discharge valve 328 position, piston position, and/or bellows position. Data received by the control system 490 (e.g. from one or more sensors) may be used to carry out operations with respect to the pump 300 and/or system 100. For example, the control system 490 may evaluate the data and determine one or more action based on the evaluation. In some embodiments, the control system 490 may automatically take action based on the evaluation.

The one or more applications 610 may comprise one or more software applications, one or more scripts, one or more programs, one or more functions, one or more executables, or one or more other modules that are interpreted or executed by the processor 602. For example, the one or more applications 610 may include a fracture design module, a reservoir simulation tool, a hydraulic fracture simulation model, or any other appropriate function block. The one or more applications 610 may include machine-readable instructions for performing one or more of the operations related to any one or more embodiments of the present disclosure. The one or more applications 610 may include machine-readable instructions for generating a user interface or a plot, for example, illustrating fracture geometry (for example, length, width, spacing, orientation, etc.), pressure plot, hydrocarbon production performance, pump performance. The one or more applications 610 may obtain input data, such as treatment data, geological data, fracture data, or other types of input data, from the memory 606, from another local source, or from one or more remote sources (for example, via the one or more communication links 614). The one or more applications 610 may generate output data and store the output data in the memory 606, hard drive 608, in another local medium, or in one or more remote devices (for example, by sending the output data via the communication link 614).

Memory controller hub 604 may include a memory controller for directing information to or from various system memory components within the information handling system 600, such as memory 606, storage element 616, and hard drive 608. The memory controller hub 604 may be coupled to memory 606 and a graphics processing unit (GPU) 618. Memory controller hub 604 may also be coupled to an I/O controller hub (ICH) or south bridge 620. I/O controller hub 620 is coupled to storage elements of the information handling system 600, including a storage element 616, which may comprise a flash ROM that includes a basic input/output system (BIOS) of the computer system. I/O controller hub 620 is also coupled to the hard drive 608 of the information handling system 600. I/O controller hub 320 may also be coupled to an I/O chip or interface, for example, a Super I/O chip 622, which is itself coupled to several of the I/O ports of the computer system, including a keyboard 624, a mouse 626, a monitor (or other display) 628 and one or more communications link 614. Any one or more input/output devices receive and transmit data in analog or digital form over one or more communication links 614 such as a serial link, a wireless link (for example, infrared, radio frequency, or others), a parallel link, or another type of link. The one or more communication links 614 may comprise any type of communication channel, connector, data communication network, or other link. For example, the one or more communication links 614 may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to FIG. 6 without departing from the scope of the present disclosure. For example, FIG. 6 shows a particular configuration of components of control system 490. However, any suitable configurations of components may be used. For example, components of control system 490 may be implemented either as physical or logical components. Furthermore, in some embodiments, functionality associated with components of control system 490 may be implemented in special purpose circuits or components. In other embodiments, functionality associated with components of control system 490 may be implemented in configurable general-purpose circuit or components. For example, components of control system 490 may be implemented by configured computer program instructions.

In bellows-style pumps, for example pumps configured to introduce treatment fluid into a well, various components of the pump may experience harsh operating conditions. For example, the discharge valve may experience high pressures and/or abrasive and/or corrosive treatment fluid, which can degrade the discharge valve. Such degradation can, over time, negatively impact the sealing capabilities of the discharge valve, which may lead to leakage of treatment fluid back into the chamber of the pump through the discharge valve. For example, a leaking discharge valve can potential cause a problem when the bellows pump is stopped (e.g. for maintenance or for reduction of overall flow rate into the well, when a plurality of pumps are jointly used to pump treatment fluid). Discharge valve leakage can allow pressurized treatment fluid to flow backward into the chamber of the pump, and while the pump is stopped, this leakage of fluid can cause a pressure build-up/accumulation in the chamber.

Oftentimes, the bellows of a bellows pump can be a fairly fragile element, for example due to its need to be expandable. For example, sufficient leakage of treatment fluid through the discharge valve back into the chamber can cause a pressure imbalance (e.g. between the external pressure in the chamber and the internal pressure within the bellows), with the pressure imbalance of fluids being separated only by the thin bellows material. Such a pressure imbalance may damage the bellows, for example crushing the bellows (e.g. beyond its minimum desired length). Besides damage to the bellows itself, a damaged bellows may lead to additional system damage and/or extended maintenance and/or pump downtime. Disclosed embodiments may address one or more such concerns, for example preventing and/or reducing pressure build-up due to discharge valve leakage, thereby improving pump functionality and reducing maintenance issues (for example, allowing the leaking discharge valve to be replaced without the need to replace the bellows or other system components which might otherwise have been damaged).

Figure 7:
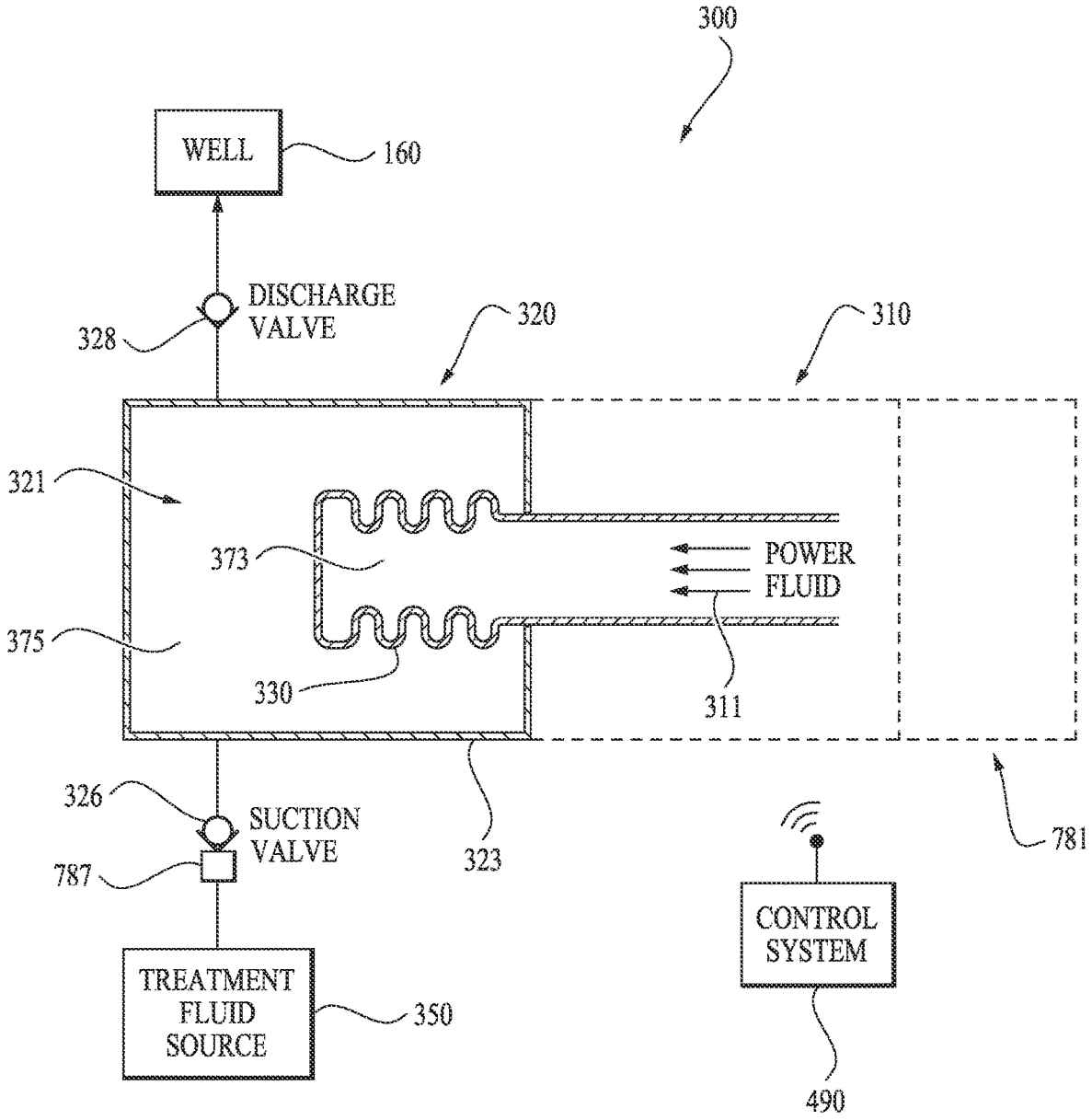
FIG. 7 is a schematic illustration of an exemplary bellows pump system, according to an embodiment of the disclosure.

FIG. 7 is a schematic illustration of an exemplary bellows pump system, according to an embodiment of the disclosure. For example, the system of FIG. 7 may include a source of treatment fluid 350; a bellows pump 300 having a power end 310, a fluid end 320 having a chamber 321, and an expandable bellows 330 disposed in the chamber 321 and in fluid communication with the power end 310; a suction valve 326 in fluid communication with the chamber 321 and the source of treatment fluid 350; a discharge valve 328 in fluid communication with the chamber 321 and the well 160; and a venting mechanism 787 configured to vent the chamber 321 of treatment fluid. In embodiments, the power end 310 can be configured to reciprocally expand and contract the bellows 330 within the chamber 321 based on movement of drive fluid. In embodiments, the bellows 330 can be configured to separate the drive fluid of the power end 310 from the treatment fluid in the chamber 321. In some embodiments, the power end 310 can have a piston disposed in a bore, for example configured to reciprocate within the bore (see FIG. 4 for example). For example, the power end 310 can be configured to reciprocally provide discharge and suction strokes, with a discharge stroke by the power end 310 expanding the bellows 330 within the chamber 321 (e.g. thereby driving treatment fluid in the chamber 321 out through the discharge valve 328) and a suction stroke by the power end 310 contracting the bellows 330 within the chamber 321 (e.g. thereby introducing treatment fluid into the chamber 321 through the suction valve 326). In embodiments, the suction valve 326 is closed and the discharge valve 328 is open during a discharge stroke, and the discharge valve 328 is closed and the suction valve 326 is open during a suction stroke.

The venting mechanism 787 may be configured to vent the chamber 321 in the event of stoppage of the pump 300 (e.g. responsive to pump stoppage). For example, pump stoppage may be based on a stop command (e.g. issued by the control system 490 and/or by a user) or on one or more sensor detecting one or more parameter of the system to determine that the pump 300 has stopped (e.g. no movement of the bellows 330 and/or the power end 310 for a plurality of cycles or for a given timeframe). In embodiments, venting the chamber 321 may comprise draining any fluid out of the chamber 321 until the pump is restarted (e.g. venting the chamber 321 for the duration of pump stoppage).

Figure 10:
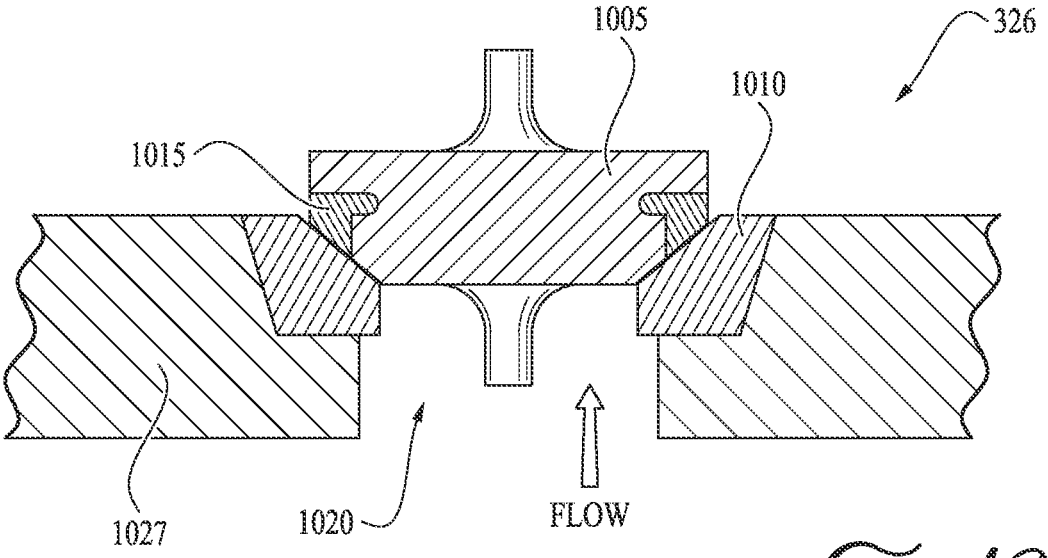
FIG. 10 is a schematic cross-sectional view an exemplary suction valve (or other one-way check valve), according to an embodiment of the disclosure.

In some embodiments, the suction valve 326 and the discharge valve 326 may each be one-way valves (e.g. one-way check valves). The venting mechanism 787 may be configured to open the suction valve 326 to allow treatment fluid to flow out of the chamber 321 through the open suction valve 326 (e.g. towards the source of treatment fluid 350). In embodiments, for example as illustrated in FIG. 10, the suction valve 326 may comprise a one-way check valve having a poppet 1005 and a seat 1010 (e.g. with the seat 1010 extending around a passage 1020 through the suction valve body 1027). The poppet 1005 may be biased against the seat 1010 to a closed position (e.g. preventing/restricting fluid flow through the suction valve 326, e.g. from the opposite direction) but be configured so that, when the biasing force is overcome (e.g. by pressure differential between the two sides of the poppet 1005—such as a pressure differential between the chamber 321 and the treatment fluid source 350), the poppet 1005 lifts off the seat 1010 to an open position (e.g. allowing fluid flow through the suction valve 326—e.g. between the seat 1010 and the poppet 1005 and/or into the chamber 321). In some embodiments, the venting mechanism 787 can be configured to force the suction valve 326 to the open position, responsive to pump stoppage, and to hold the suction valve 326 in the open position for the duration of pump stoppage (e.g. until the pump is restarted).

Figure 11:
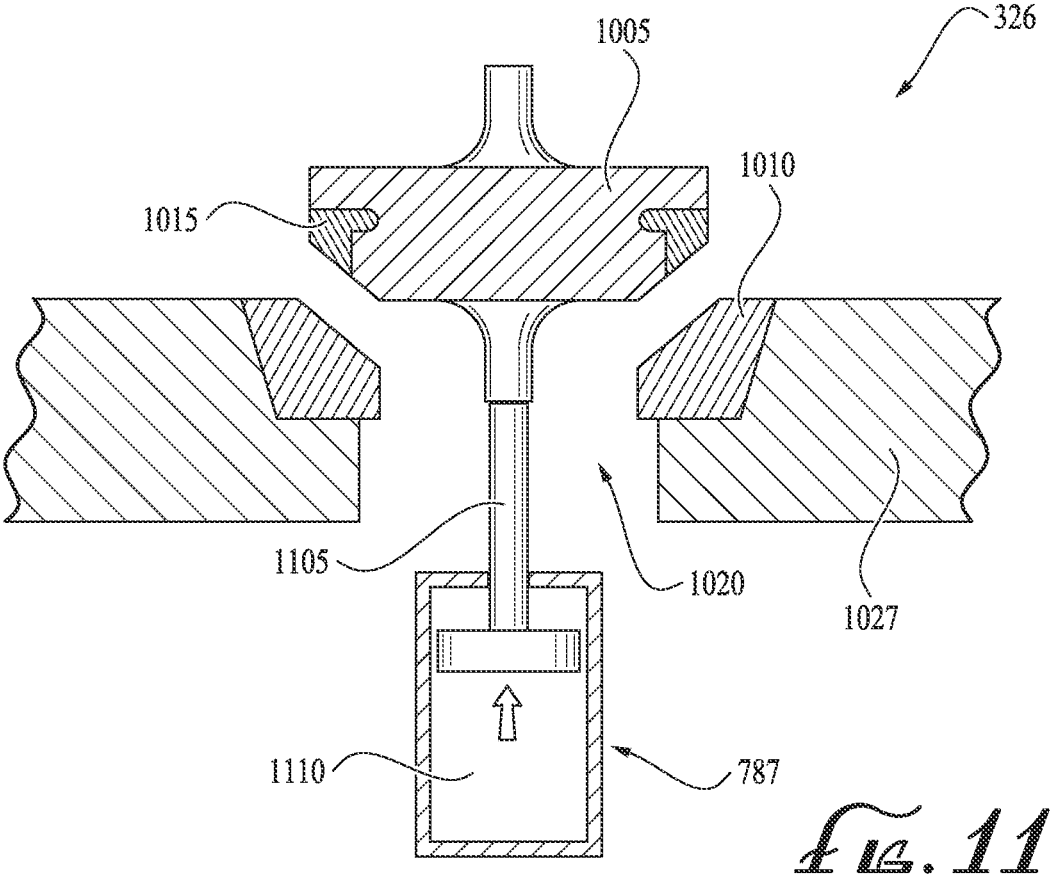
FIG. 11 is a schematic cross-sectional view of the exemplary suction valve of FIG. 10 forced to an open position by an exemplary venting mechanism, according to an embodiment of the disclosure.

In some embodiments, for example as illustrated in FIG. 11, the venting mechanism 787 may have an extended position and retracted position. For example, in the extended position (shown in in FIG. 11), the poppet 1005 can be in the open position (e.g. lifted from the seat 1010). In the extended position, the venting mechanism 787 may overcome biasing to force open the suction valve 326, thereby allowing leakage of treatment fluid in the chamber 321 to flow out through the suction valve 326. In the retracted position (similar to FIG. 10), the poppet 1005 can be in the closed position (e.g. contacting/seated on the seat 1010). In the retracted position, the venting mechanism 787 may release the poppet 1005, allowing the biasing force/element to close the suction valve 326. Once released, the suction valve 326 can operate as a one-way check valve again, thereby preventing treatment fluid in the chamber 321 from exiting through the suction valve 326. In the extended position, the venting mechanism 787 may contact the poppet 1005 on a proximate surface (e.g. in proximity to the seat/opposite the chamber and/or distal to the chamber) and may hold the poppet 1005 off the seat 1010 (e.g. in the open position). In the retracted position, the venting mechanism 787 may not apply sufficient force (e.g. to the poppet 1005) to overcome the biasing, allowing the poppet 1005 to retract and/or to contact the seat 1010 (e.g. in a closed position). In some embodiments, in the retracted position, the venting mechanism 787 may not contact the poppet 1005 at all.

In some embodiments, the venting mechanism 787 can be external to the chamber 321. For example, in the extended position, the venting mechanism 787 may extend through the seat 1010 of the suction valve 326 (e.g. through the passage 1020) to contact the poppet 1005. The venting mechanism 787 can be disposed opposite the poppet 1005 with respect to the valve seat 1010 (e.g. with the valve seat 1010 being disposed axially between the poppet 1005 and the venting mechanism 787 in the closed position). In some embodiments, the venting mechanism 787 can include an actuator 1110 and a vent rod 1105, with the actuator 1110 configured to move the vent rod 1105 between the extended and retracted positions. In the extended position, the vent rod 1105 may contact the poppet 1005 on a proximate surface (e.g. in proximity to the seat/opposite the chamber) and may hold the poppet 1005 off the seat 1010 (e.g. in the open position). In the retracted position, the vent rod 1105 may not apply sufficient force to overcome the biasing and/or may not contact the poppet 1005 at all (e.g. allowing the poppet 1005 to remain in contact with the seat 1010). In the extended position, the vent rod 1105 may extend through the seat 1010 (e.g. passage) of the suction valve 326 to contact the poppet 1005. In some embodiments, in the open position, fluid from the source of treatment fluid 350 may flow around the vent rod 1105 and the poppet 1005 and into the chamber 321, for example during pumping of treatment fluid using the pump 300. By way of example, the suction valve 326 and venting mechanism 787 can be configured so that, during pumping, fluid may flow around the vent rod 1105 and the poppet 1005 and into the chamber 321. Alternatively, fluid from the source of treatment fluid 350 may flow past the vent rod 1105, around the poppet 1005, and into the chamber 321, for example depending on the position of the venting mechanism 787 with respect to the suction valve 326 and/or the fluid flow path between the source of treatment fluid 350 and the suction valve 326 during pumping.

Typically, the suction valve 326 can also include a seal 1015 configured to prevent fluid flow through the suction valve 326 in the closed position. For example, the seal 1015 can be disposed on the poppet 1005 and/or the seat 1010. In embodiments, the seal 1015 may be configured for use with/contact with treatment fluid (e.g. resistant to treatment fluid, so as not to readily degrade due to exposure to treatment fluid). For example, the seal 1015 may be abrasive and/or corrosive (e.g. acid) resistant. In embodiments, the vent rod 1105 can be configured to extend axially through the suction valve 326 (e.g. the seat/passage), for example along the centerline axis of the suction valve/seat/passage. Some poppet 1005 embodiments may have a contact element configured for contact with the vent rod 787 when the vent rod 787 is in the extended position. In some embodiments, the contact element may extend from the surface of the poppet 1005 distal to the chamber 321 (e.g. extending through the passage/opening 1020 in the seat 1010). In some embodiments, the poppet 1005 and the seat 1010 may have corresponding contact surfaces (e.g. corresponding angled surfaces), and the seal 1015 may be disposed on one or both contact surfaces.

Figure 8:
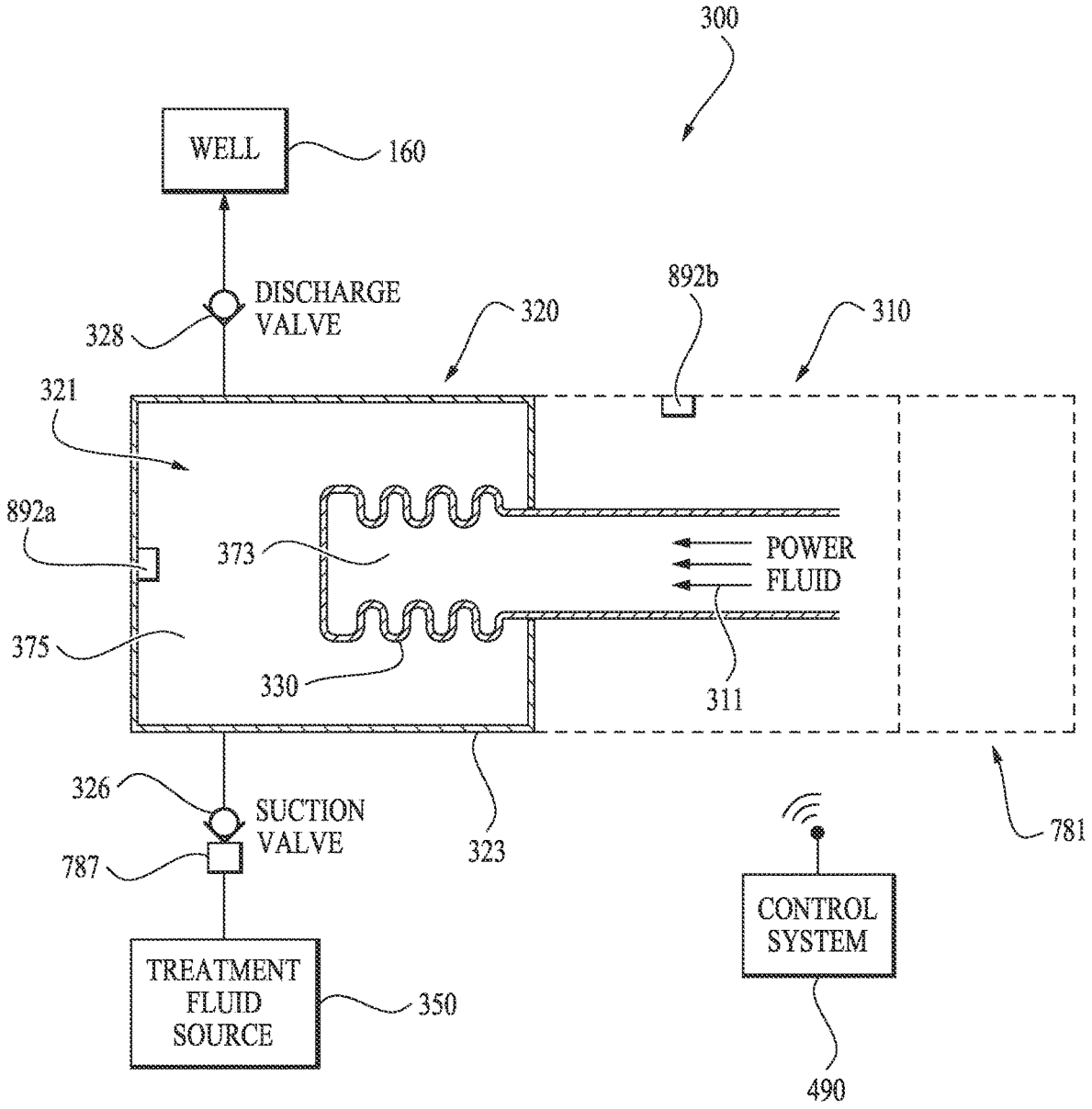
FIG. 8 is a schematic illustration of another exemplary bellows pump system, according to an embodiment of the disclosure.

Some bellows pump systems may additionally include a control system 490. In some embodiments, the control system 490 may be configured to stop the pump 300 (e.g. issue a stoppage command to the pump/driver), responsive to receiving a stop command. See for example, FIG. 7. The stop command can be a normal stop command (for example stoppage based on maintenance or on reducing pumping volume into the well) or an emergency stop command. The stop command can be issued by a user/personnel, or maybe automated in some embodiments. In some embodiments, the control system 490 may include one or more sensor configured to detect one or more parameter of the system at one or more location in the system, and the control system 490 may be configured to receive data from the one or more sensor (for example, the types of data which might be used to evaluate the need for an emergency stop, such as a synchronization error, a prime mover fault, flowrate, undesirable well response, pressure, temperature, electrical fault, sensor fault, detectable bad valve condition, and/or bellows damage detection), to evaluate the sensor data to detect an emergency stop condition, and responsive to detecting an emergency stop condition, to stop the pump 300 (e.g. issuing a stoppage command to the pump/driver). In some embodiments, responsive to pump stoppage, the control system 490 may be configured to instruct the venting mechanism 787 to vent the chamber 321 (e.g. with the venting mechanism 787 in the extended position). In some embodiments, the control system 490 may have one or more sensor 892*a*, 892*b* configured to detect one or more parameter of the system at one or more location in the system, wherein the control system 490 is configured to receive data from the one or more sensor 892*a*, 892*b* (e.g. position data for the bellows 330 and/or piston, hydraulic system performance data, such as flow and/or pressure, and/or data indicating that a prime mover (e.g. a driver) has stopped), to evaluate the sensor data to detect pump 300 stoppage (e.g. no movement of the bellows 330 or power end 310, for example compared to a pre-set threshold), and responsive to detecting pump 300 stoppage, to instruct the venting mechanism 787 to vent the chamber 321 (e.g. with the venting mechanism 787 in the extended position). See for example, FIG. 8, illustrating an exemplary system. In some system embodiments, responsive to restarting of the pump 300, the control system 490 may be configured to instruct the venting mechanism 787 to stop venting the chamber 321 (e.g. with the venting mechanism 787 in the retracted position (e.g. releasing the suction valve 326, so that the suction valve 326 may again operate as a one-way check valve).

Figure 9:
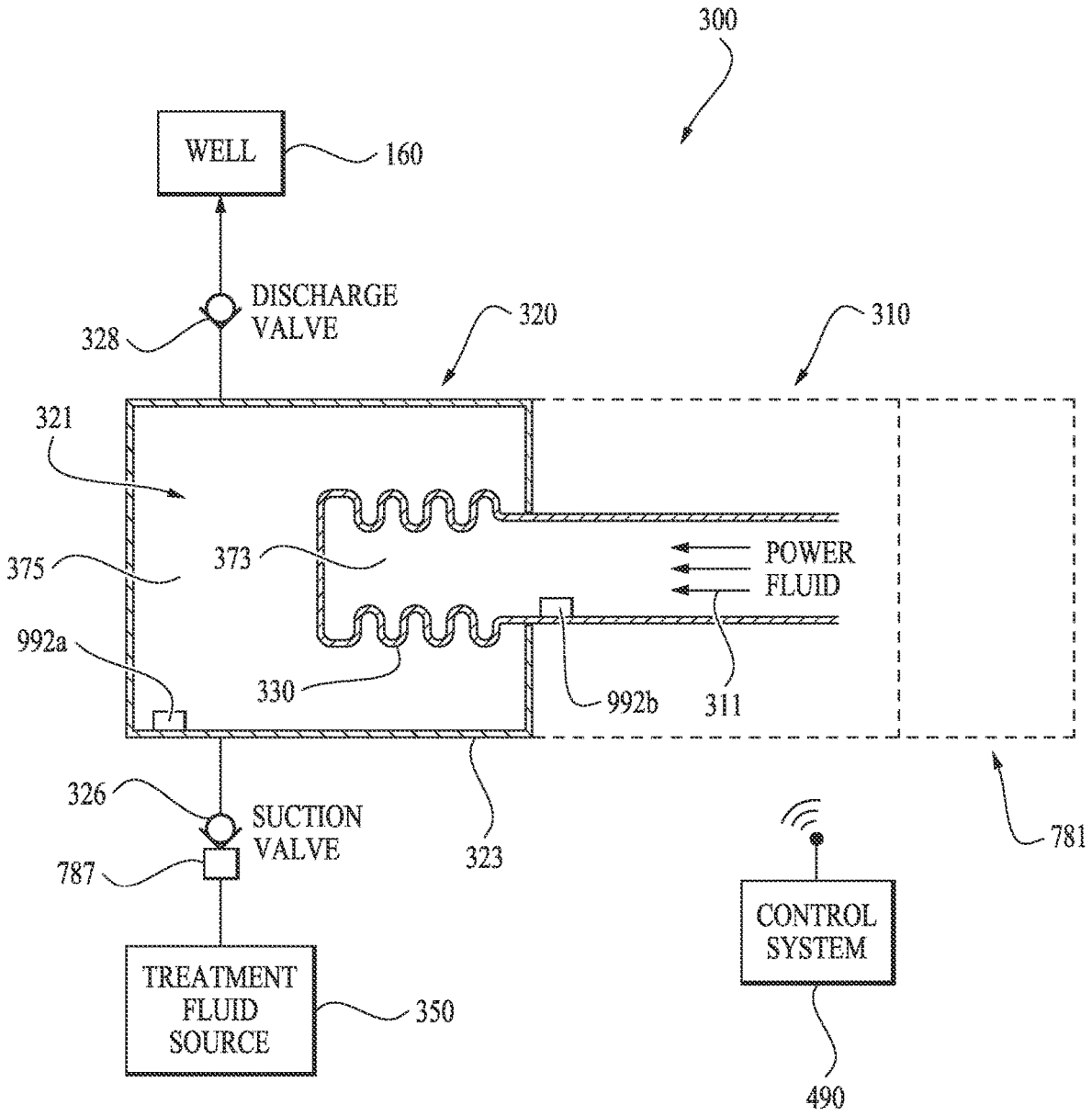
FIG. 9 is a schematic illustration of yet another exemplary bellows pump system, according to an embodiment of the disclosure.

While some embodiments may be configured to vent the chamber 321 upon pump stoppage, other embodiments may be configured to vent the chamber 321 based on detection of a leak. For example, in FIG. 9 the venting mechanism 787 may be configured to vent the chamber 321 in the event that leakage is detected (e.g. responsive to detection of leakage of treatment fluid into the chamber 321 through the discharge valve 328). For example, the control system 490 may have one or more sensor 992*a*, 992*b* configured to detect one or more parameter of the system at one or more location in the system, and the control system 490 may be configured to receive data from the one or more sensor 992*a*, 992*b* (e.g.

configured to detect one or more parameter of the system indicative of a discharge leak—such as pressure in the chamber 321, pressure in the bellows 330, flow rate, and/or detection of poor valve performance), to evaluate the sensor data to detect a leak (e.g. of treatment fluid into the chamber 321 through the discharge valve 328), and responsive to detecting a leak, to open the suction valve 326 (e.g. instruct the venting mechanism 787 to vent the chamber 321).

In some embodiments, responsive to opening the suction valve, the control system 490 may be configured to stop the pump 300 (e.g. issue a stoppage command to the pump/driver). In other embodiments, the suction valve 326 may be held open (e.g. by the venting mechanism 787) even while the pump 300 runs. For example, the suction valve 326 may be held open even as the bellows 330 reciprocates in the chamber 321 and/or as the driver element 781 continues to operate. Holding the suction valve 326 open even as the pump 300 runs may protect the bellows 330 from damage due to excessive pressure in the chamber 321. This approach may be particularly useful in system embodiments in which more than one bellows and/or more than one pump is commonly driven.

Figure 12:
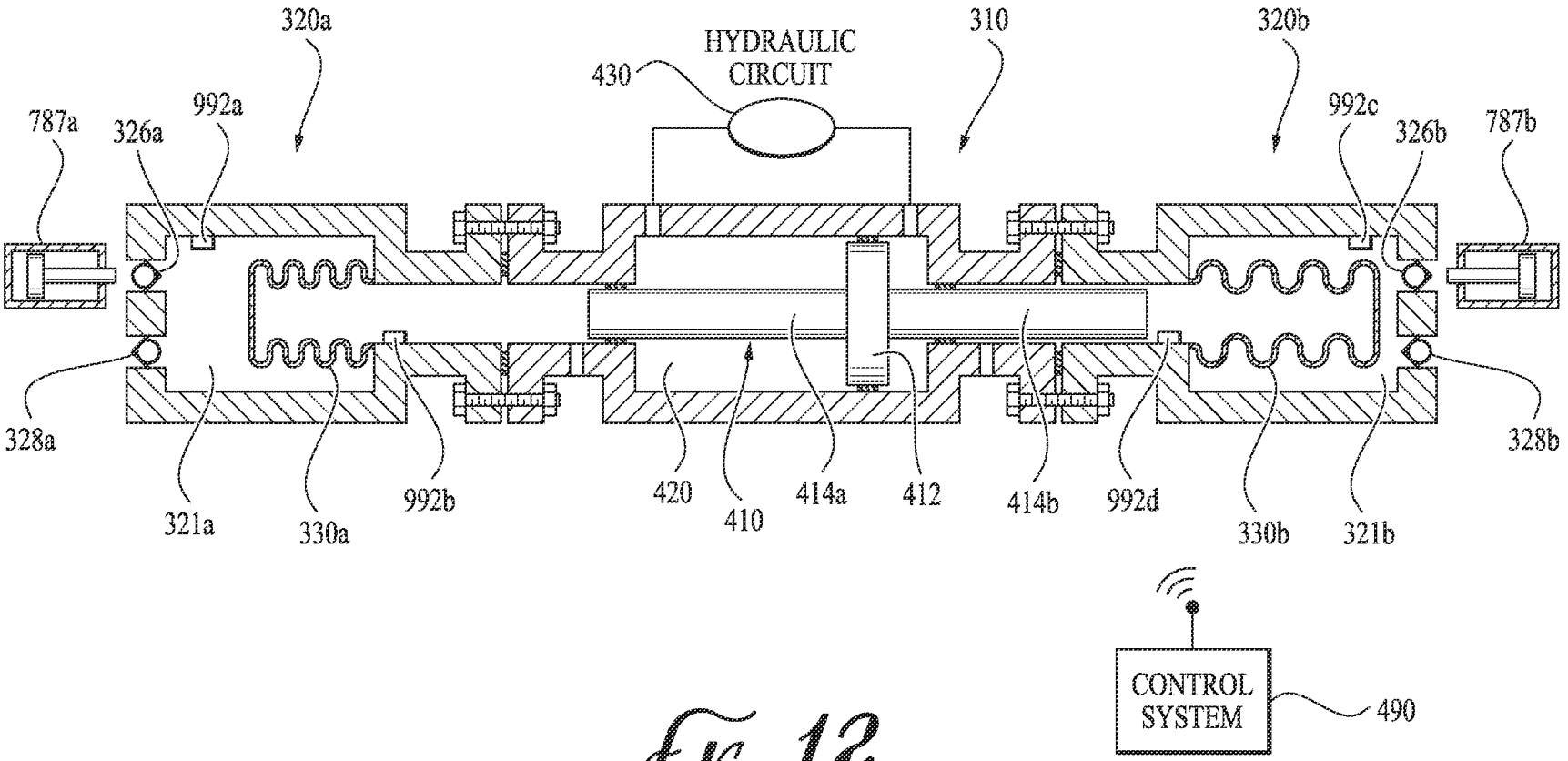
FIG. 12 is a schematic illustration of an exemplary dual bellows pump system, according to an embodiment of the disclosure.

For example, in some embodiments the pump 300 may be a dual bellows pump (see for example, FIG. 12) further having a second fluid end (e.g. having a first fluid end 320*a* and a second fluid end 320*b*). The first fluid end 320*a* may be similar to the embodiments described above with respect to FIGS. 7-11. The second fluid end 320*b* may include a second chamber 321*b*, a second suction valve 326*b* in fluid communication with the second chamber 321*b* and the source of treatment fluid 350 (or another/second source of treatment fluid—e.g. the source of treatment fluid can include multiple sources of treatment fluid), a second discharge valve 328*b* in fluid communication with the second chamber 321*b* and the well 160, and a second expandable bellows 330*b* disposed in the second chamber 321*b* and in fluid communication with the power end 310. In some embodiments, the second fluid end 320*b* may be substantially the same as the first fluid end 320*a* (e.g. which may be substantially the same as the fluid end embodiments described herein). The power end 310 can be configured to reciprocally expand and contract the both the first bellows 330*a* and the second bellows 330*b* based on movement of drive fluid. In embodiments, the bore 420 of the power end 310 can be fluidly coupled to (e.g. in fluid communication with) both the first fluid end 320*a* and second fluid end 320*b* (e.g. the first bellows 330*a* and second bellows 330*b*). The bore 420 may extend out of two (e.g. opposite) sides of the power end 310, for example with two second portions of the bore 420 (e.g. configured for the rod, as discussed above) extending from a single first portion of the bore 420 (e.g. configured for the head, as discussed above).

The power end 310 can be configured to reciprocally expand and contract both the first and second bellows 330*a*, 330*b* based on movement of drive fluid by the piston 410. For example, the piston 410 may have a head 412 and two rods 414*a*, 414*b*, with the rods 414*a*, 414*b* extending from opposite sides of the head 412 (e.g. with the first rod 414*a* extending towards the first fluid end 320*a*/bellows 330*a* and the second rod 414*b* extending towards the second fluid end 320*b*/bellows 330*b*). In some embodiments, the two rods 414*a*, 414*b* may be aligned (e.g. having the same longitudinal centerline axis) and/or may extend outward along the centerline axis of the head 412 and/or first portion 422 of the bore 420. The driver, such as a hydraulic circuit 430 (see FIG. 4), may be configured to reciprocate the piston 410 based on pressure differential across the head 412 of the piston 410, thereby reciprocating the rods 414*a*, 414*b* (and thereby the bellows 330*a*, 330*b*).

In embodiments, the venting mechanism 787*a* can be configured to vent the first chamber 321*a* in the event that leakage is detected in the first chamber 321*a* (e.g. responsive to detection of leakage of fluid into the first chamber 321*a* through the first discharge valve 328*b*). For example, the control system 490 may have one or more sensor 992*a*, 992*b* configured to detect one or more parameter of the system at one or more location in the system, and the control system 490 may be configured to receive data from the one or more sensor 992*a*, 992*b*, to evaluate the sensor data to detect a leak (e.g. of treatment fluid into the first chamber 321*a* through the first discharge valve 328*a*), and responsive to detecting a leak (e.g. in the first chamber 321*a* and/or through the first discharge valve 328*a*), to vent the first chamber 321*a*. In embodiments, the first suction valve 326*a* may be held open (e.g. by the first venting mechanism 787*a*) even while the dual bellows pump 300 continues to run. For example, the first suction valve 326*a* may be held open while the second bellows 330*b* continues to pump treatment fluid through the second chamber 321*b* to the well and/or while the piston 410/driver (e.g. hydraulic circuit 430 in FIG. 12) continues to provide reciprocation. In some embodiments, despite the pump 300 continuing the run, holding the first suction valve 326*a* open may protect the first bellows 330*a* from damage due to leakage through the first discharge valve 326*b*. This may allow the pump 300 to continue operating using one side (e.g. the second fluid end 320*b*) of the dual bellows pump, even when there is a detected leak causing the other side (e.g. the first fluid end 320*a*) of the dual bellows pump to be disabled/protected (e.g. to protect the bellows on the leaking side from damage).

Some system embodiments can further comprise a second venting mechanism 787*b* (e.g. which may be similar to the first venting mechanism 787*a*) configured to vent the second chamber 321*b* of treatment fluid. The first and second venting mechanisms 787*a*, 789*b* may be configured to vent their corresponding chamber in the event that leakage is detected in the corresponding chamber 321*a*, 321*b* (e.g. responsive to detection of leakage of fluid into the corresponding chamber 321*a*, 321*b* through the corresponding discharge valve 328*a*, 328*b*). In embodiments, the control system 490 may have one or more sensor 992*a*-992*d* configured to detect one or more parameter of the system at one or more location in the system, and the control system 490 may be configured to receive data from the one or more sensor 992*a*-992*d*, to evaluate the sensor data to detect a leak (e.g. of treatment fluid into the first or second chamber 321*a*, 321*b* and/or through the first or second discharge valve 328*a*, 328*b*), and responsive to detecting a leak, to vent the corresponding chamber 321*a*, 321*b* (e.g. to open the corresponding suction valve 326*a*, 326*b*, for example by instructing the corresponding venting mechanism 787*a*, 787*b*). The corresponding suction valve may be held open even while the dual bellows pump 300 continues to runs (e.g. while the bellows of the non-leaking chamber pumps treatment fluid through the correspond chamber to the well and/or while the piston/driver continues to reciprocate).

Figure 13:
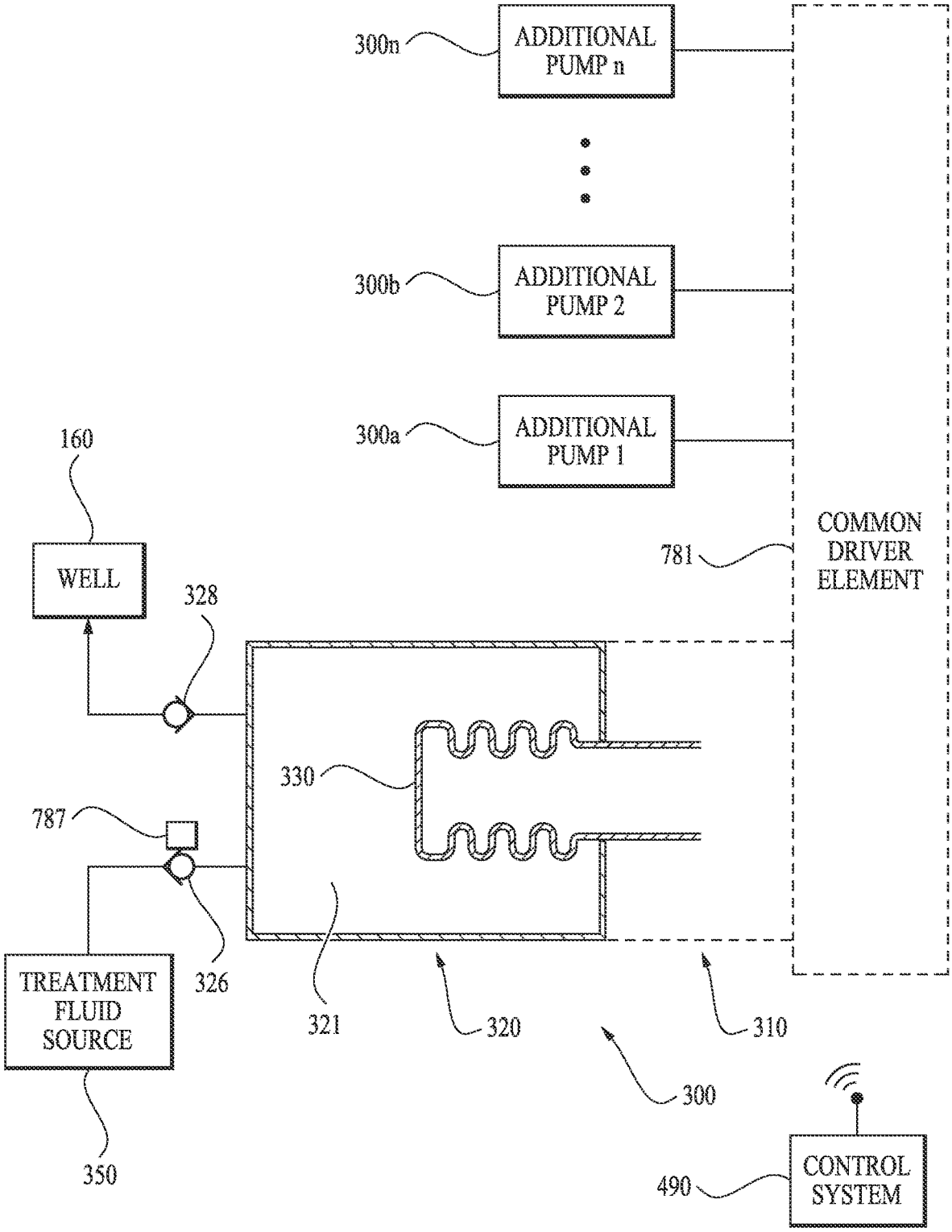
FIG. 13 is a schematic illustration of still another exemplary bellows pump system, according to an embodiment of the disclosure.

In other examples, the bellows pump 300 (which may be a single or dual bellows pump) may be just one of a plurality of pumps jointly operating to pump treatment fluid into the well. For example, in addition to the bellows pump 300 embodiments described above (for example with respect to FIGS. 7-11), the system can also include one or more additional pump 300*a*-300*n* and a common driver element 781. The common driver element 781 can be configured to drive the power end 310 of the bellows pump 300 and the one or more additional pumps 300*a*-300*n* (e.g. simultaneously). The bellows pump 300 and the one or more additional pumps 300*a*-300*n* can be configured to jointly pump treatment fluid to the well 160. FIG. 13 provides a schematic illustration of a system having a bellows pump 300 and multiple additional pumps (e.g. 300*a*-300*n*) configured to jointly pump treatment fluid into a well 160. In some embodiments, the plurality of pumps may be configured to provide constant pumping at approximately constant pressure. For example, one or more pump (e.g. 300*a*) may be configured so that its power stroke is out of sync with the power stroke of one or more other of the pumps (e.g. 300*b*). In some embodiments, half of the pumps may be configured to have their power/discharge strokes in sync, for example when the other half of the pumps are having their suction stroke. In some embodiments, all of the pumps may draw from the same treatment fluid source 350, while in other embodiments, one or more of the pumps may draw from an independent fluid source.

As discussed above, the venting mechanism 787 can be configured to vent the chamber 321 of the bellows pump 300 in the event that leakage is detected in the chamber 321 (e.g. responsive to detection of leakage of fluid into the chamber 321 through the discharge valve 328). For example, the control system 490 may have one or more sensor (as previously discussed) configured to detect one or more parameter of the system at one or more location in the system, and the control system 490 may be configured to receive data from the one or more sensor, to evaluate the sensor data to detect a leak (e.g. of treatment fluid into the chamber 321 and/or through the discharge valve 328), and responsive to detecting a leak (e.g. in the chamber 321 of the bellows pump 300 and/or through the discharge valve 328), to vent the chamber 321 (e.g. instructing the venting mechanism 787 to vent the chamber 321, for example by opening the suction valve 326). In embodiments, the suction valve 326 of the bellows pump 300 can be held open even while the one or more additional pump 300*a*-300*n* continues to run (e.g. while the one or more additional pump 300*a*-300*n* introduces treatment fluid into the well and/or while the common driver 781 continues to reciprocate). This may allow the system to continue operating using the one or more additional pump 300*a*-300*n*, even when there is a detected leak causing the bellows pump 300 to be disabled (e.g. configured so as to not pump treatment fluid, to protect the bellows 330 from damage). In some embodiments, the one or more additional pumps 300*a*-300*n* (e.g. of a multi-pump system, for example with the multiple pumps driven by a common driver element 781) may also be similarly configured to the bellows pump 300 and/or to each other, for example with a venting mechanism 787 for holding open the suction valve in the event of a discharge valve leak.

Figure 14:
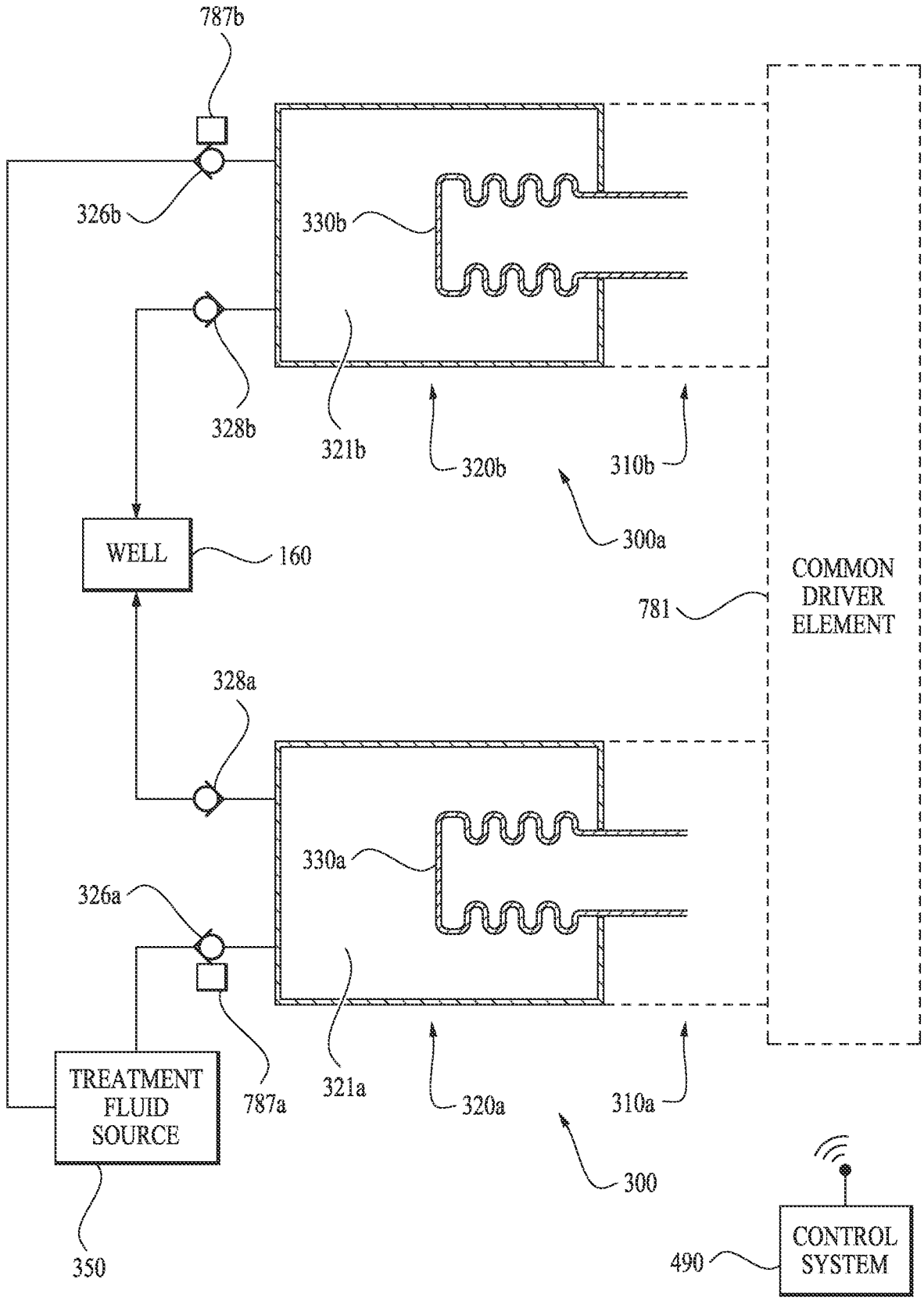
FIG. 14 is a schematic illustration of yet another exemplary bellows pump system, according to an embodiment of the disclosure.

FIG. 14 illustrates a similar exemplary system, in which two bellows pumps 300*a*, 300*b* (which may be similar) are driven by a common driver element 781. If a leak is detected in either chamber 330*a* or 330*b*, the corresponding venting mechanism 787*a*, 787*b* may operate to vent the corresponding chamber 321*a*, 321*b* (for example holding the corresponding suction valve 326*a*, 326*b* open). The other pump may continue to operate (e.g. continuing to introduce treatment fluid into the well via the non-leaking pump) and/or the common driver element 781 may continue operating. This may allow the system to continue operating, even when there is a detected leak causing one of the bellows pump to be disabled/vented.

While many embodiments may vent the chamber by holding open the suction valve, in alternate embodiments, the venting mechanism can include a separate vent valve configured to allow venting of the chamber. For example, the vent valve may be an active valve, and the venting mechanism can be configured to open the vent valve to allow treatment fluid to flow out of the chamber through the vent valve (e.g. either due to pump stoppage or due to detection of a leak). In some embodiments, the fluid flowing out of the chamber through the venting valve may be directed to the source of treatment fluid. In some embodiments, the fluid flowing out of the chamber during venting may be recirculated back into the chamber once pump operation resumes.

Variations of all disclosed embodiments, for example having and/or deleting one or more aspects of various disclosed embodiments illustrated in the figures, are included herein. As persons of skill will appreciate, various aspects illustrated in one or more of the disclosed embodiments may be combined and/or deleted, thereby illustrating still further disclosed embodiments included within the scope of this disclosure.

While the suction valve 326 and the discharge valve 328 may each be one-way check valves, in alternate embodiments, any other suitable valve may be used as either the suction valve 326 and/or discharge valve 328. For example, the suction valve 326 could be an active valve, and the control system 490 could use an actuator/venting mechanism to operate the valve (in standard pumping operation and/or for venting to protect the bellows). Although not required, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver element/mechanism 781 capable of reciprocally expanding and contracting the bellows 330 may be used, and are included within the scope of this disclosure.

So, the bellows pump according to certain embodiments of the present disclosure may comprise a valve management system that includes one or more check valves that allow the treatment fluid to flow in a selected direction within the bellows pump. For example, the bellows pump may include at least a discharge valve and a suction valve, and the discharge valve and/or the suction valve may comprise a one-way check valve that only allows the treatment fluid to flow downstream of the fluid treatment source (e.g. with the suction valve between the fluid treatment source and the chamber/bellows, and the discharge valve between the chamber/bellows and the well). In some embodiments, the suction valve may comprise a check valve that includes an actuator that is configured open the suction valve when the operation of the bellows pump is stopped, inter alia, to allow treatment fluid to flow upstream of the fluid end and the bellows out of the bellows pump and/or to a treatment fluid source or collection vessel. This may, in some instances, prevent amounts of treatment fluid from flowing back into the fluid end and thereby prevent that treatment fluid from damaging the bellows and/or otherwise hindering operation of the pump.

Returning now to FIG. 7, a bellows pump 300 may have a fluid end body 320 with an internal cavity (e.g. chamber 321). In the operation of the bellows pump 300, the driving fluid can be separated from the treatment fluid by the bellows 330, which may be comprised of a thin flexible material that separates the internal cavity of the fluid end 320 into at least a first volume within the bellows 330 and a second volume in the chamber 321 outside the bellows 330. In some embodiments, the bellows 330 may not be designed to withstand significant pressure differentials between the first volume and the second volume. Instead, the bellows 330 serves as a fluid separating barrier between the first volume for driving fluid (e.g. within the bellows 330) and the second volume for treatment fluid (e.g. in the chamber 321). During operation of the bellows pump 300, the bellows 330 can flex axially to keep pressure balanced between first volume and the second volume during operation. On a discharge stroke, as driving fluid enters first volume, the bellows 330 inflates and treatment fluid is expelled from the second volume (e.g. the chamber 321) through discharge valve 328. Once the discharge stroke is complete, a suction stroke begins. During the suction stroke, the bellows 330 deflates, and treatment fluid is drawn through suction valve 336 into the chamber 321. Once the bellows 330 is compressed to its minimum desired length, another discharge stroke begins. In some embodiments, one or both of discharge valve 328 and suction valve 326 may comprise a check valve system, as shown for example in FIGS. 10-11 and described in further detail below.

Referring back to FIG. 7, when the operation of the bellows pump 300 is stopped, the treatment fluid may leak through discharge valve 328 (opposite the direction of flow shown), allowing pressurized treatment fluid to flow backward into the chamber 321 inside fluid end 320. In some instances, this leakage of pressurized fluid could cause the bellows 330 to be crushed or compressed beyond the desired minimum length, which can cause damage to the bellows 330 or otherwise interfere with the proper operation of the bellows pump 300. Therefore, in some embodiments, it may be advantageous to use a discharge valve 328 that is less prone to allow leakage.

In some embodiments, a check valve system that may be used in such applications (e.g., as the discharge valve 328 or the suction valve 326) is illustrated in FIG. 10. When the check valve is in the closed position as shown in FIG. 10, poppet 1005 is seated against seat 1010 on the outlet (e.g. passage 1020) of the valve. The poppet 1005 can be urged off seat 1010 by fluid flow through passage 1020 only in one direction (i.e., as indicated by the flow arrow), and thus only allows fluid to pass between seat 1010 and poppet 1005 when flowing in the indicated direction. Fluid flow through outlet/passage 1020 in the reverse direction is prevented by the poppet 1005 being forced against the seat 1010 by the fluid and sealed against the seat by an elastomeric insert/seal 1015 on poppet 1005. In some embodiments, an elastomeric insert may be installed on seat 1010 instead of or in addition to the elastomeric insert on poppet 1005, among other reasons, to improve the integrity of the seal between the poppet 1005 and the seat 1010. Such check valve systems may be used for one or both of the suction valve 326 and discharge valve 328. In some embodiments, the check valve systems may be passive and urged to their closed positions by springs, which may provide the biasing force urging the valves towards their closed positions.

In some instances, it may be desirable to temporarily stop the operation of the bellows pump 300 during the treatment operation for a number of different reasons. For example, in the case of a fracturing operation, it may be desirable to stop the operation of the pump 300 for a short period of time to create pressure pulses in the subterranean formation, which may enhance the nature of the fractures formed therein. In other instances, operation of the pump 300 may be stopped when the total flow rate required from a plurality of pumps is reduced, or if the pump 300 is stopped for maintenance activities or remedial measures. In cases where the bellows pump 300 is stopped, it may be desirable to prevent accumulation of reverse-leaking treatment fluid from accumulating in the fluid end body (e.g. chamber 321). One method to accomplish this is to force open the suction valve 326 of the bellows pump 300 to allow treatment fluid leakage to return to the treatment fluid source 350 upstream of the suction valve.

FIG. 11 shows a check valve system similar to that of FIG. 10, but modified to include a mechanism (e.g. venting mechanism 787) for forcing the suction valve 326 open, e.g., to allow treatment fluid leakage to return to the treatment fluid source 350 upstream of the suction valve 326. When used as the suction valve (e.g., valve 326 in FIG. 7), the check valve system can be used to prevent treatment fluid from accumulating inside the chamber 321 and causing damage to the bellows 330 or otherwise hindering operation of the bellows pump 300. In this embodiment, an actuator 1110 can be used to hold poppet 1005 off its seat 1010 by extending a rod 1105 against poppet 1005 and thus opening a flow passage between the poppet 1005 and the seat 1010 which can allow for reverse flow. In some embodiments, the rod 1105 may be attached to the poppet 1005. Actuator 1110 may comprise any type of mechanism that can cause the poppet 1005 to travel axially (i.e., in the upward direction in FIG. 11, towards the poppet 1005). In some embodiments, the actuator 1110 may comprise an electric actuator, a hydraulically-driven actuator, a mechanically-driven actuator, a pneumatically-driven actuator, a magnetically-driven actuator, a spring-loaded actuator, a solenoid, a linear actuator, or any combination or variation thereof. As a person of skill in the art would understand, the present disclosure may utilize any actuator of any suitable design and configuration in the check valve system of FIG. 11, and may configure that actuator to engage the poppet 1005 in any suitable manner.

When the bellows pump 300 of FIG. 7 is stopped, actuator 1110 lifts poppet 1005 off of seat 1010 thus creating the flow passage through which any treatment fluid that might leak into the fluid end body (e.g. chamber 321) may instead flow through the suction valve 326 (e.g., through valve 326 in the reverse direction of the flow indicated by the arrow). In some embodiments, the fluid may be recovered to a treatment fluid source 350 for recirculation into the bellows pump 300, another pumping system, or other system for conditioning of the treatment fluid. When operation of bellows pump 300 resumes, actuator 1110 retracts downward, allowing poppet 1005 to return to seat 1010 and function again as a one-way check valve.

One or more bellows pumps with a valve management system according to the present disclosure may be used in conjunction with any type of fracturing or other treatment fluid operation and in any suitable capacity in the treatment system. In some embodiments, one or more bellows pumps may be used as the primary fracturing pumps in a fracturing system or operation. In some embodiments, one or more bellows pumps may be used in combination with other fracturing pumps, e.g., as an intensifier or booster to increase the pressure of the fracturing fluid.

Disclosed embodiments also comprise exemplary methods for pumping treatment fluid into a well. Such methods may use any of the disclosed pump or system embodiments, such as the examples illustrated in FIGS. 7-14. For example, an exemplary method embodiment may comprise: pumping treatment fluid into the well using a bellows pump having a chamber with a bellows disposed therein (e.g. using any of the pump system embodiments disclosed herein); and responsive to pump stoppage, venting fluid from the chamber. In embodiments, venting fluid from the chamber may further comprise venting the chamber for the duration of pump stoppage (e.g. until the pump is restarted, and treatment fluid is again introduced into the well). In embodiments, venting fluid may comprise opening a suction valve in fluid communication with the chamber, and holding the suction valve open for the duration of pump stoppage (e.g. until the pump is restarted, and treatment fluid is again introduced into the well). In embodiments, opening the suction valve may involve moving a venting mechanism to an extended position. Opening a suction valve and holding it open may act to temporarily reconfigure the suction valve from a one-way check-valve to an open port (e.g. for the duration of the suction valve being held open).

Embodiments may further comprise releasing the suction valve, for example responsive to re-starting the pump. In embodiments, releasing the suction valve may include moving the venting mechanism to a retracted position. Method embodiments may also include, responsive to opening the suction valve, draining/venting/reversing flow of treatment fluid from the chamber (e.g. through the suction valve to the source of treatment fluid). Some embodiments also comprise recovering treatment fluid (e.g. at the source of treatment fluid) for recirculation upon pump restart.

Some method embodiments may further comprise, responsive to receiving (e.g. at the control system) sensor data from one or more sensor configured to detect one or more parameter of the bellows pump system (e.g. one or more sensor disposed on the bellows pump—for example one or more position sensor), detecting (e.g. using the control system) pump stoppage based on the sensor data. And in some embodiments, responsive to detecting pump stoppage, the method may include venting fluid from the chamber. For example, embodiments may include opening a suction valve in fluid communication with the chamber, and holding the suction valve open for the duration of pump stoppage (e.g. until the pump is restarted, and treatment fluid is again introduced into the well). Other method embodiments may further comprise, responsive to receiving (e.g. at the control system) a stop command (which may be an emergency stop command in some instances), venting fluid from the chamber (e.g. opening a suction valve in fluid communication with the chamber, and holding the suction valve open for the duration of pump stoppage (e.g. until the pump is restarted, and treatment fluid is again introduced into the well).

While the method embodiments described above relate to venting the chamber in the event of pump stoppage, in other embodiments, venting may be based on detection of leakage. For example, another exemplary method may comprise pumping treatment fluid into the well using a bellows pump having a chamber with a bellows disposed therein (e.g. using any of the pump system embodiments disclosed herein); responsive to receiving (e.g. at the control system) sensor data from one or more sensor configured to detect one or more parameter of the bellows pump system (e.g. one or more sensor disposed on the bellows pump and configured to detect one or more parameter indicative of leakage, such as pressure in the chamber and/or bellows), detecting (e.g. using the control system) a leak (e.g. in the chamber and/or through the discharge valve) based on the sensor data; and responsive to detecting a leak, venting fluid from the chamber (e.g. opening a suction valve in fluid communication with the chamber, and holding the suction valve open). In some embodiments, the pump may be stopped in response to venting the fluid and/or detecting leakage. In other embodiments, venting the fluid can occur/continue even while the pump is running (e.g. while the bellows and/or power end/driver element is reciprocating). For example, some embodiments may include continuing to reciprocate the bellows and/or piston and/or drive element, even while the suction valve is held open.

For example, in some embodiments the pump may be a dual bellows pump, and the suction valve (e.g. the suction valve corresponding to the chamber having a leak) may be held open even while the dual bellows pump continues to run (e.g. while the second bellows pumps treatment fluid through a second chamber to the well and/or while the piston continues to reciprocate). This may allow continued pumping of treatment fluid into the well (e.g. pumping via the second bellows of the dual bellows pump), even while the suction valve is held open (e.g. in relation to the chamber with a leak).

In another example, pumping treatment fluid may occur using one or more additional pump (as well as the bellows pump, e.g. jointly working to pump treatment fluid). For example, the bellows pump and the one or more additional pump can be driven by a common driver element. In such system embodiments, the method may include continuing to pump treatment fluid into the well (e.g. using the one or more additional pump), even while the suction valve is held open in the bellows pump. For example, the suction valve may be held open, even while the common driver continues to reciprocate and/or the one or more additional pumps continue to introduce treatment fluid into the well.

One or more of the pump embodiments disclosed herein (e.g. relating to FIGS. 7-14) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments or aspects thereof, and/or a non-transitory computer-readable medium can have program instructions stored thereon configured to cause a control system (e.g. of the bellows pump system) to perform any of the disclosed method embodiments or aspects thereof. Such instructions may be used by the control system of the disclosed bellows pump system embodiments, for example to operate the bellows pump system (which may include disclosed pump embodiments).

ADDITIONAL DISCLOSURE

The following are non-limiting, specific embodiments in accordance with the present disclosure:

In a first embodiment, a system for introducing treatment fluid into a well comprises: a source of treatment fluid; a bellows pump with a power end, a fluid end having a chamber, and an expandable bellows disposed in the chamber and in fluid communication with the power end, wherein the power end is configured to reciprocally expand and contract the bellows within the chamber based on movement of drive fluid; a suction valve in fluid communication with the chamber and the source of treatment fluid; a discharge valve in fluid communication with the chamber and the well; and a venting mechanism configured to vent the chamber of treatment fluid.

A second embodiment can include the system of the first embodiment, wherein: the power end comprises a piston disposed in a bore (e.g. configured to reciprocate within the bore); the bellows is configured to separate the drive fluid of the power end from the treatment fluid in the chamber; the power end is configured to reciprocally provide discharge and suction strokes, with a discharge stroke by the power end expanding the bellows within the chamber (e.g. thereby driving treatment fluid in the chamber out through the discharge valve) and a suction stroke by the power end contracting the bellows within the chamber (e.g. thereby introducing treatment fluid into the chamber through the suction valve); the suction valve is closed and the discharge valve is open during a discharge stroke; the discharge valve is closed and the suction valve is open during a discharge stroke; and/or the suction valve and the discharge valve are each one-way valves (e.g. one-way check valves).

A third embodiment can include the system of the first or second embodiment, wherein the venting mechanism is configured to (e.g. automatically) vent the chamber in the event of stoppage of the pump (e.g. responsive to pump stoppage).

A fourth embodiment can include the system of the third embodiment, wherein pump stoppage may be based on a stop command (e.g. issued by the control system and/or by a user) or on one or more sensor detecting one or more parameter of the system to determine that the pump is stopped (e.g. no movement of the bellows and/or the power end for a plurality of cycles or for a given timeframe).

A fifth embodiment can include the system of any one of the first to fourth embodiments, wherein venting the chamber comprises draining any fluid out of the chamber until the pump is restarted (e.g. venting the chamber for the duration of pump stoppage).

A sixth embodiment can include the system of any one of the first to fifth embodiments, wherein the venting mechanism is configured to open the suction valve to allow treatment fluid to flow out of the chamber through the open suction valve (e.g. towards the source of treatment fluid).

A seventh embodiment can include the system of any one of the first to sixth embodiments, wherein the suction valve comprises a one-way check valve having a poppet and a seat (e.g. with the seat extending around a passage through the suction valve body), wherein the poppet is biased against the seat to a closed position (e.g. preventing/restricting fluid flow through the suction valve, e.g. from the opposite direction) but is configured so that when biasing force is overcome (e.g. by pressure differential between the two sides of the poppet—such as a pressure differential between the chamber and the treatment fluid source), the poppet lifts off the seat to an open position (e.g. allowing fluid flow through the suction valve—e.g. between the seat and the poppet and/or into the chamber).

An eighth embodiment can include the system of any one of the first to seventh embodiments, wherein, the venting mechanism is configured to force the suction valve to the open position, responsive to pump stoppage, and to hold the suction valve in the open position for the duration of pump stoppage (e.g. until the pump is restarted).

A ninth embodiment can include the system of any one of the seventh to eighth embodiments, wherein the venting mechanism comprises an extended position and retracted position, wherein in the extended position, the poppet is in the open position—lifted from the seat (e.g. overcoming the biasing to open the suction valve, thereby allowing treatment fluid (e.g. leakage) in the chamber to flow out through the suction valve), and in the retracted position, the poppet is in the closed position—contacting/seated on the seat (e.g. with the biasing force/element closing the suction valve, thereby preventing treatment fluid in the chamber from exiting through the suction valve).

A tenth embodiment can include the system of the ninth embodiment, wherein in the extended position, the venting mechanism contacts the poppet on a proximate surface (e.g. in proximity to the seat/opposite the chamber (e.g. distal to the chamber)) and holds the poppet off the seat (e.g. in the open position); and/or in the retracted position, the venting mechanism does not apply sufficient force (e.g. to the poppet) to overcome the biasing (allowing the poppet to contact the seat (e.g. in a closed position).

An eleventh embodiment can include the system of any one of the first to tenth embodiments, wherein the venting mechanism is external to the chamber.

A twelfth embodiment can include the system of any one of the seventh to eleventh embodiments, wherein in the extended position, the venting mechanism extends through the seat of the suction valve (e.g. through the passage) to contact the poppet.

A thirteenth embodiment can include the system of any one of the ninth to twelfth embodiments, wherein the venting mechanism comprises an actuator and a vent rod, wherein the actuator is configured to move the vent rod between the extended and retracted positions.

A fourteenth embodiment can include the system of the thirteenth embodiment, wherein in the extended position, the vent rod contacts the poppet on a proximate surface (e.g. in proximity to the seat/opposite the chamber) and holds the poppet off the seat (e.g. in the open position); and in the retracted position, the vent rod does not apply sufficient force to overcome the biasing (allowing the poppet to contact the seat (e.g. in a closed position).

A fifteenth embodiment can include the system of any one of the first to fourteenth embodiments, wherein the suction valve further comprises a seal (e.g. disposed on the poppet and/or the seat) configured to prevent fluid flow through the suction valve in the closed position.

A sixteenth embodiment can include the system of the fifteenth embodiment, wherein the seal is configured for use with/contact with treatment fluid (e.g. resistant to treatment fluid, so as not to readily degrade due to exposure to treatment fluid).

A seventeenth embodiment can include the system of any one of the thirteenth to sixteenth embodiments, wherein the vent rod is configured to extend axially through the suction valve (e.g. the seat/passage) (e.g. along the centerline axis of the suction valve/seat/passage).

An eighteenth embodiment can include the system of any one of the first to seventeenth embodiments, further comprising a control system, wherein responsive to receiving a stop command, the control system is configured to stop the pump (e.g. issue a stoppage command to the pump/driver).

A nineteenth embodiment can include the system of any one of the first to seventeenth embodiments, further comprising a control system having one or more sensor configured to detect one or more parameter of the system at one or more location in the system, wherein the control system is configured to receive data from the one or more sensor, to evaluate the sensor data to detect an emergency stop condition, and responsive to detecting an emergency stop condition, to stop the pump (e.g. issue a stoppage command to the pump/driver).

A twentieth embodiment can include the system of the eighteenth or nineteenth embodiments, wherein responsive to pump stoppage, the control system is configured to instruct/control the venting mechanism to vent the chamber (e.g. with the venting mechanism in the extended position).

A twenty-first embodiment can include the system of any one of the first to seventeenth embodiments, further comprising a control system having one or more sensor configured to detect one or more parameter of the system at one or more location in the system, wherein the control system is configured to receive data from the one or more sensor (e.g. position data for the bellows and/or piston), to evaluate the sensor data to detect pump stoppage (e.g. no movement of the bellows or power end compared to a pre-set threshold), and responsive to detecting pump stoppage, to instruct/control the venting mechanism to vent the chamber (e.g. with the venting mechanism in the extended position).

A twenty-second embodiment can include the system of any one of the eighteenth to twenty-first embodiments, wherein responsive to restarting of the pump, the control system is configured to instruct/control the venting mechanism to stop venting the chamber/to release the suction valve (e.g. with the venting mechanism in the retracted position, so that the suction valve may again operate as a one-way check valve).

A twenty-third embodiment can include the system of any one of the first to twenty-second embodiments, wherein the venting mechanism is configured to vent the chamber in the event that leakage is detected (e.g. responsive to detection of leakage of treatment fluid into the chamber through the discharge valve).

A twenty-fourth embodiment can include the system of any one of the first to twenty-third embodiments, further comprising a control system having one or more sensor configured to detect one or more parameter of the system at one or more location in the system, wherein the control system is configured to receive data from the one or more sensor (e.g. configured to detect one or more parameter of the system indicative of a discharge leak—such as pressure in the chamber and/or pressure in the bellows), to evaluate the sensor data to detect a leak (e.g. of treatment fluid into the chamber through the discharge valve), and responsive to detecting a leak, to open the suction valve (e.g. instruct/control the venting mechanism to vent the chamber/open the suction valve—e.g. with the venting mechanism in the extended position).

A twenty-fifth embodiment can include the system of the twenty-fourth embodiment, wherein responsive to opening the suction valve, the control system is configured to stop the pump (e.g. issue a stoppage command to the pump/driver).

A twenty-sixth embodiment can include the system of the twenty-third or twenty-fourth embodiment, wherein the suction valve is held open even while the pump runs (e.g. as the bellows reciprocates in the chamber and/or as the driver element continues to operate).

A twenty-seventh embodiment can include the system of any one of the twenty-third to twenty-sixth embodiments, wherein the pump comprises a dual-bellows pump further comprising a second fluid end having a second chamber, a second suction valve in fluid communication with the second chamber and the source of treatment fluid (or another/second source of treatment fluid—e.g. the source of treatment fluid can include multiple sources of treatment fluid), a second discharge valve in fluid communication with the second chamber and the well, and a second expandable bellows disposed in the second chamber and in fluid communication with the power end, wherein the power end is configured to reciprocally expand and contract the both the first bellows and the second bellows based on movement of drive fluid.

A twenty-eighth embodiment can include the system of the twenty-seventh embodiment, wherein the venting mechanism is configured to vent the first chamber in the event that leakage is detected in the first chamber (e.g. responsive to detection of leakage) (e.g. leakage of fluid into the first chamber through the first discharge valve).

A twenty-ninth embodiment can include the system of any one of the twenty-seventh to twenty-eighth embodiments, further comprising a control system having one or more sensor configured to detect one or more parameter of the system at one or more location in the system, wherein the control system is configured to receive data from the one or more sensor, to evaluate the sensor data to detect a leak (e.g. of treatment fluid into the first chamber through the first discharge valve), and responsive to detecting a leak (e.g. in the first chamber and/or through the first discharge valve), to vent the first chamber/to open the first suction valve (e.g. instruct the venting mechanism to vent the first chamber).

A thirtieth embodiment can include the system of the twenty-ninth embodiment, wherein the first suction valve is held open (e.g. by the first venting mechanism) even while the dual bellows pump continues to run (e.g. while the second bellows continues to pump treatment fluid through the second chamber to the well and/or while the piston/driver continues to reciprocate).

A thirty-first embodiment can include the system of any one of the twenty-seventh to thirtieth embodiments, further comprising a second venting mechanism (which may be similar to the first venting mechanism) configured to vent the second chamber of treatment fluid.

A thirty-second embodiment can include the system of the thirty-first embodiment, wherein the first and second venting mechanisms are configured to vent the corresponding chamber in the event that leakage is detected in the corresponding chamber (e.g. responsive to detection of leakage of fluid into the corresponding chamber through the corresponding discharge valve).

A thirty-third embodiment can include the system of any one of the thirty-first or thirty-second embodiments, further comprising a control system having one or more sensor configured to detect one or more parameter of the system at one or more location in the system, wherein the control system is configured to receive data from the one or more sensor, to evaluate the sensor data to detect a leak (e.g. of treatment fluid into the first or second chamber and/or through the first or second discharge valve), and responsive to detecting a leak, to vent the corresponding chamber/to open the corresponding suction valve (e.g. instruct/control the corresponding venting mechanism to vent the corresponding chamber).

A thirty-fourth embodiment can include the system of the thirty-third embodiment, wherein the corresponding suction valve is held open even while the dual bellows pump continues to runs (e.g. while the bellows of the non-leaking chamber pumps treatment fluid through the correspond chamber to the well and/or while the piston/driver continues to reciprocate).

A thirty-fifth embodiment can include the system of any one of the first to thirty-fourth embodiments, wherein the system comprises one or more additional pump and a common driver element, wherein the common driver element is configured to drive the power end of the bellows pump and the one or more additional pumps (e.g. simultaneously).

A thirty-sixth embodiment can include the system of the thirty-fifth embodiment, wherein the bellows pump and the one or more additional pumps are configured to jointly pump treatment fluid to the well.

A thirty-seventh embodiment can include the system of any one of the thirty-fifth or thirty-sixth embodiments, wherein the venting mechanism is configured to vent the chamber in the event that leakage is detected in the chamber (e.g. responsive to detection of leakage) (e.g. leakage of fluid into the chamber through the discharge valve).

A thirty-eighth embodiment can include the system of the thirty-seventh embodiment, wherein venting the chamber comprises venting the chamber even while the one or more additional pump continues to run (e.g. while the one or more additional pump introduces treatment fluid into the well and/or while the common driver continues to reciprocate).

A thirty-ninth embodiment can include the system of any one of the thirty-fifth to thirty-eighth embodiments, further comprising a control system having one or more sensor configured to detect one or more parameter of the system at one or more location in the system, wherein the control system is configured to receive data from the one or more sensor, to evaluate the sensor data to detect a leak (e.g. of treatment fluid into the chamber and/or through the discharge valve), and responsive to detecting a leak (e.g. in the chamber and/or through the discharge valve), to vent the chamber—to open the suction valve (e.g. instruct the venting mechanism to vent the chamber-open the suction valve—e.g. with the venting mechanism in the extended position).

A fortieth embodiment can include the system of the thirty-ninth embodiment, wherein the suction valve is held open even while the one or more additional pump continues to run (e.g. while the one or more additional pump introduces treatment fluid into the well and/or while the common driver continues to reciprocate).

In a forty-first embodiment, a method for pumping treatment fluid into a well comprises: pumping treatment fluid into the well using a bellows pump having a chamber with a bellows disposed therein; responsive to pump stoppage, venting fluid from the chamber.

A forty-second embodiment can include the method of the forty-first embodiment, wherein venting fluid from the chamber further comprises venting the chamber for the duration of pump stoppage (e.g. until the pump is restarted, and treatment fluid is again introduced into the well).

A forty-third embodiment can include the method of the forty-first embodiment, wherein venting fluid comprises opening a suction valve in fluid communication with the chamber, and holding the suction valve open for the duration of pump stoppage (e.g. until the pump is restarted, and treatment fluid is again introduced into the well).

A forty-fourth embodiment can include the method of the forty-third embodiment, wherein opening the suction valve comprises moving a venting mechanism to an extended position.

A forty-fifth embodiment can include the method of the forty-third or forty-fourth embodiment, further comprising releasing the suction valve responsive to re-starting the pump.

A forty-sixth embodiment can include the method of any one of the forty-third to forty-fifth embodiments, wherein responsive to opening the suction valve, draining/venting/reversing flow of treatment fluid from the chamber (e.g. through the suction valve to the source of treatment fluid).

A forty-seventh embodiment can include the method of any one of the forty-first to forty-sixth embodiments, further comprising recovering treatment fluid (e.g. at the source of treatment fluid) for recirculation upon pump restart.

A forty-eighth embodiment can include the method of any one of the forty-first to forty-seventh embodiments, further comprising, responsive to receiving (e.g. at the control system) sensor data from one or more sensor configured to detect one or more parameter of the bellows pump system (e.g. one or more sensor disposed on the bellows pump—for example one or more position sensor), detecting (e.g. using the control system) pump stoppage based on the sensor data.

A forty-ninth embodiment can include the method of the forty-eighth embodiment, responsive to detecting pump stoppage (e.g. by the control system), venting fluid from the chamber (e.g. opening a suction valve in fluid communication with the chamber, and holding the suction valve open for the duration of pump stoppage (e.g. until the pump is restarted, and treatment fluid is again introduced into the well).

A fiftieth embodiment can include the method of any one of the forty-first to forty-seventh embodiments, further comprising, responsive to receiving (e.g. at the control system) a stop command (which may be an emergency stop command in some instances), venting fluid from the chamber (e.g. opening a suction valve in fluid communication with the chamber, and holding the suction valve open for the duration of pump stoppage (e.g. until the pump is restarted, and treatment fluid is again introduced into the well).

In a fifty-first embodiment, a method for introducing treatment fluid into a well, comprising: pumping treatment fluid into the well using a bellows pump having a chamber with a bellows disposed therein; responsive to receiving (e.g. at the control system) sensor data from one or more sensor configured to detect one or more parameter of the bellows pump system (e.g. one or more sensor disposed on the bellows pump and configured to detect one or more parameter indicative of leakage, such as pressure in the chamber and/or bellows), detecting (e.g. using the control system) a leak (e.g. in the chamber and/or through the discharge valve) based on the sensor data; and responsive to detecting a leak, venting fluid from the chamber (e.g. opening a suction valve in fluid communication with the chamber, and holding the suction valve open).

A fifty-second embodiment can include the method of the fifty-first embodiment, responsive to venting the fluid and/or detecting a leak, stopping the pump.

A fifty-third embodiment can include the method of the fifty-first embodiment, wherein venting the fluid occurs even while the pump is running (e.g. the bellows/power end/driver element is reciprocating) (e.g. continue reciprocating the bellows/piston/drive element, even while the suction valve is held open).

A fifty-fourth embodiment can include the method of the fifty-first or fifty-third embodiment, wherein the pump comprises a dual bellows pump, wherein the suction valve (e.g. the suction valve corresponding to the chamber having a leak) is held open even while the dual bellows pump continues to run (e.g. while the second bellows pumps treatment fluid through a second chamber to the well and/or while the piston/driver element continues to reciprocate)/further comprising continuing to pump treatment fluid into the well, even while the suction valve is held open (e.g. using the second bellows of the dual bellows pump).

A fifty-fifth embodiment can include the method of any one of the fifty-first, fifty-third, or fifty-fourth embodiments, wherein pumping treatment fluid occurs using one or more additional pump (as well as the bellows pump, e.g. jointly working to pump treatment fluid), wherein the bellows pump and the one or more additional pump are driven by a common driver element, further comprising continuing to pump treatment fluid into the well (e.g. using the one or more additional pump) even while the suction valve is held open (e.g. holding the suction valve open even while the common driver reciprocates).

A fifty-sixth embodiment can include the method of any one of the forty-first to fifty-fifth embodiments, wherein the pump/system comprises any one of the first to fortieth pump/system embodiments.

A fifty-seventh embodiment can include the pump/system of any one of the first to fortieth embodiments, configured to carry out the method of any one of the forty-first to fifty-fifth embodiments.

In a fifty-eighth embodiment, a programmable storage device having program instructions stored thereon for causing a processor to perform the method according to any one of the forty-first to fifty-fifth embodiments and/or for being used by the pump/system of any one of the first to fortieth embodiments.

In a fifty-ninth embodiment, a non-transitory computer-readable medium having program instructions stored thereon for causing a control system to perform the method of any one of the forty-first to fifty-fifth embodiments and/or for being used by the pump/system of any one of the first to fortieth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

It should similarly be understood that terms such as "hot," "cold," "hotter," "cooler," "colder," and other such temperature terms are relative terms and do not denote any specific temperature. Rather, reference to a hot fluid means that the fluid is hotter than a cool fluid of the system and/or has been heated, while reference to a cool fluid means a fluid that is cooler/colder than a hot fluid of the system and/or has not been heated or has been heated less than the fluid of another portion of the system (for example another portion of the system with which the fluid is interacting).

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C"

is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for pumping treatment fluid into a well, comprising:

a source of treatment fluid;

a bellows pump comprising:

a power end;

a fluid end having a chamber; and an expandable bellows disposed in the chamber and in fluid communication with the power end, wherein the power end is configured to reciprocally expand and contract the bellows within the chamber based on movement of drive fluid;

a suction valve in fluid communication with the chamber and the source of treatment fluid;

a discharge valve in fluid communication with the chamber and the well; and a venting mechanism configured to vent the chamber of treatment fluid;

wherein, responsive to detection of leakage of treatment fluid back into the chamber through the discharge valve, the venting mechanism is configured to vent the chamber.

2. The system of claim 1, wherein the venting mechanism is further configured to vent the chamber responsive to pump stoppage.

3. The system of claim 2, wherein venting the chamber comprises venting the chamber for the duration of pump stoppage.

4. The system of claim 1, further comprising a control system, wherein responsive to receiving a stop command, the control system is configured to stop the pump and to operate the venting mechanism to vent the chamber.

5. The system of claim 1, further comprising a control system having one or more sensor configured to detect one or more parameter of the system at one or more location in the system, wherein the control system is configured to receive data from the one or more sensor, to evaluate the sensor data to detect pump stoppage, and responsive to detecting pump stoppage, to operate the venting mechanism to vent the chamber.

6. The system of claim 4, wherein responsive to restarting of the pump, the control system is configured to operate the venting mechanism to stop venting the chamber.

7. The system of claim 1, wherein:

the bellows pump comprises a dual-bellows pump further comprising a second fluid end having a second chamber, a second suction valve, a second discharge valve, and a second expandable bellows disposed in the second chamber and in fluid communication with the power end;

the power end is configured to reciprocally expand and contract the both the first bellows and the second bellows based on movement of drive fluid; and venting the chamber comprises holding only the suction valve open, even while the dual bellows pump continues to run.

8. A system for pumping treatment fluid into a well, comprising:

a source of treatment fluid;

a bellows pump comprising:

a power end;

a fluid end having a chamber; and an expandable bellows disposed in the chamber and in fluid communication with the power end, wherein the power end is configured to reciprocally expand and contract the bellows within the chamber based on movement of drive fluid;

a suction valve in fluid communication with the chamber and the source of treatment fluid;

a discharge valve in fluid communication with the chamber and the well; and a venting mechanism configured to vent the chamber of treatment fluid, wherein:

the suction valve comprises a one-way check valve having a poppet and a seat;

the poppet is biased against the seat to a closed position but is configured so that, when biasing force is overcome, the poppet lifts off the seat to an open position; and the venting mechanism is configured to force the suction valve to the open position, responsive to pump stoppage, and to hold the suction valve in the open position for the duration of pump stoppage.

9. A system for pumping treatment fluid into a well, comprising:

a source of treatment fluid;

a bellows pump comprising:

a power end;

a fluid end having a chamber; and an expandable bellows disposed in the chamber and in fluid communication with the power end, wherein the power end is configured to reciprocally expand and contract the bellows within the chamber based on movement of drive fluid;

a suction valve in fluid communication with the chamber and the source of treatment fluid;

a discharge valve in fluid communication with the chamber and the well;

a venting mechanism configured to vent the chamber of treatment fluid, further comprising; and a control system having one or more sensor configured to detect one or more parameter of the system at one or more location in the system, wherein the control system is configured to receive data from the one or more sensor, to evaluate the sensor data to detect a leak of treatment fluid into the chamber through the discharge valve, and responsive to detecting a leak, to operate the venting mechanism to vent the chamber.

10. The system of claim 9, wherein venting the chamber comprises holding the suction valve open, even while the pump runs.

11. The system of claim 10, further comprising one or more additional pump and a common driver element, wherein:

the common driver element is configured to drive the power end of the bellows pump and the one or more additional pumps;

the bellows pump and the one or more additional pumps are configured to jointly introduce treatment fluid to the well; and wherein venting the chamber comprises holding the suction valve open, even while the one or more additional pump continues to introduce treatment fluid into the well.

12. A method for introducing treatment fluid into a well, comprising:

pumping treatment fluid into the well using a bellows pump having a chamber with a bellows disposed therein;

responsive to pump stoppage, venting fluid from the chamber, wherein venting fluid from the chamber comprises opening only a suction valve in fluid communication with the chamber, and holding the suction valve open for the duration of pump stoppage.

13. The method of claim 12, further comprising releasing the suction valve responsive to re-starting the pump.

14. The method of claim 12, further comprising:

responsive to receiving, at a control system, sensor data from one or more sensor configured to detect one or more parameter of the bellows pump system, detecting pump stoppage based on the sensor data; and responsive to detecting pump stoppage, opening the suction valve and holding the suction valve open for the duration of pump stoppage.

15. The method of claim 12, further comprising, responsive to receiving, at a control system, a stop command, opening the suction valve and holding the suction valve open for the duration of pump stoppage.

16. A method for introducing treatment fluid into a well, comprising:

pumping treatment fluid into the well using a bellows pump having a chamber with a bellows disposed therein;

responsive to receiving, at a control system, sensor data from one or more sensor configured to detect one or more parameter of the bellows pump system, the control system detecting a leak of treatment fluid back into the chamber through the discharge valve based on the sensor data; and responsive to detecting a leak, the control system operating a venting mechanism to venting fluid from the chamber.

17. The method of claim 16, wherein venting the fluid occurs even while the pump is running.

18. A system for pumping treatment fluid into a well, comprising:

a source of treatment fluid;

a bellows pump comprising:

a power end;

a fluid end having a chamber; and an expandable bellows disposed in the chamber and in fluid communication with the power end, wherein the power end is configured to reciprocally expand and contract the bellows within the chamber based on movement of drive fluid;

a suction valve in fluid communication with the chamber and the source of treatment fluid;

a discharge valve in fluid communication with the chamber and the well; and a venting mechanism configured to vent the chamber of treatment fluid, wherein venting the chamber comprises holding only the suction valve open using the venting mechanism.

19. The system of claim 18, wherein venting the chamber comprises holding the suction valve open with the venting mechanism without opening the discharge valve.

20. The system of claim 19, wherein the venting mechanism is configured to vent the chamber responsive to pump stoppage.

* * * * *